US012709856B2

(12) United States Patent
Henderson

(10) Patent No.: US 12,709,856 B2
(45) Date of Patent: Aug. 18, 2026

(54) POST-TENSIONED HELICAL ANCHORS SIMULTANEOUSLY SPIN-DRILLED AND GROUTED AND METHOD THEREFOR

(71) Applicant: Allan P. Henderson, Bakersfield, CA (US)

(72) Inventor: Allan P. Henderson, Bakersfield, CA (US)

( * ) Notice: Subject to any disclaimer, the term of this patent is extended or adjusted under 35 U.S.C. 154(b) by 188 days.

(21) Appl. No.: 18/165,605

(22) Filed: Feb. 7, 2023

(65) Prior Publication Data

US 2023/0250605 A1 Aug. 10, 2023

Related U.S. Application Data

(60) Provisional application No. 63/307,809, filed on Feb. 8, 2022.

(51) Int. Cl.

| | |
|---|---|
| ***E02D 7/14*** | (2006.01) |
| ***E02D 5/52*** | (2006.01) |
| ***E02D 5/56*** | (2006.01) |
| ***E02D 7/22*** | (2006.01) |

(52) U.S. Cl.

CPC ..... *E02D 5/56* (2013.01); *E02D 5/526* (2013.01); *E02D 7/22* (2013.01); *E02D 2250/003* (2013.01); *E02D 2250/0038* (2013.01); *E02D 2250/0046* (2013.01); *E02D 2300/0018* (2013.01); *E02D 2600/20* (2013.01); *E02D 2600/30* (2013.01)

(58) Field of Classification Search

CPC .. E02D 7/22; E02D 5/46; E02D 5/526; E02D 5/56; E02D 2250/003; E21B 3/02; E21B 3/022; E21B 3/04

See application file for complete search history.

(56) References Cited

U.S. PATENT DOCUMENTS

| | | | | |
|---|---|---|---|---|
| 3,300,988 A * | 1/1967 | Phares | ..... | E02D 7/22 405/239 |
| 5,586,417 A | 12/1996 | Henderson et al. | | |
| 5,826,387 A | 10/1998 | Henderson et al. | | |
| 6,672,823 B2 | 1/2004 | Henning | | |

(Continued)

FOREIGN PATENT DOCUMENTS

| | | | | |
|---|---|---|---|---|
| KR | 2020138484 A * | 12/2020 | | |
| WO | WO-9608606 A1 * | 3/1996 | ..... | E02D 5/76 |

*Primary Examiner* — Amber R Anderson

*Assistant Examiner* — Stacy N Lawson

(74) *Attorney, Agent, or Firm* — Dunlap Bennett & Ludwig PLLC

(57) ABSTRACT

An assembly and method of simultaneously spin drilling and pressure grouting a helical anchor into the ground vertically, horizontally or at an inclined angle create a continuous grouting configuration inside and outside the helical anchor for its entire depth in the ground. The helical anchor is configured to be partially or completely removed as desired and can be provided at its upper end with a tensioning element to post tension a cementitious foundation structure. A unique spin drilling and grouting assembly continuously provides grout under pressure to the interior of the helical anchor during its spin drilling into the ground. In one embodiment, the pressure grouted helical anchor is used with an upwardly extending tensioning element to reinforce cementitious foundation caps or other concrete support foundations.

15 Claims, 16 Drawing Sheets

(56) References Cited

U.S. PATENT DOCUMENTS

| | | | | |
|---|---|---|---|---|
| 7,533,505 | B2 | 5/2009 | Henderson | |
| 7,618,217 | B2 | 11/2009 | Henderson | |
| 7,707,797 | B2 | 5/2010 | Henderson | |
| 9,045,878 | B2 | 6/2015 | Henderson | |
| 2008/0031695 | A1* | 2/2008 | Nasr | E02D 5/46 405/233 |
| 2013/0255169 | A1* | 10/2013 | Henderson | E02D 27/32 52/223.13 |
| 2019/0316312 | A1* | 10/2019 | Mcmillan | E02D 5/56 |
| 2021/0017728 | A1* | 1/2021 | Dekle | E02D 5/34 |

* cited by examiner

POST-TENSIONED HELICAL ANCHORS SIMULTANEOUSLY SPIN-DRILLED AND GROUTED AND METHOD THEREFOR

CROSS REFERENCE TO RELATED APPLICATIONS

This application claims priority back to U.S. Provisional Application for Patent No. 63/307,809, filed Feb. 8, 2022, the disclosure of which is specifically incorporated by reference as if fully set forth herein.

BACKGROUND OF THE INVENTION

1. Field of the Invention

The present invention relates generally to grouted, spin-drilled helical anchors and tiebacks (lateral support anchors) typically used in soft terrain and subsurface soils that can be water-bearing, such as clay and sand, and which can be found in the Midwest region of the United States and coastal regions of North America. More particularly, the present invention relates to an assembly and method for spin drilling and grouting a helical anchor or tieback that provides soil anchoring, tension, compression, and lateral support for foundations and structures (large and small), such as concrete auger cast piles, pressure grouting casts, and cementitious foundation caps (concrete support foundations) formed in situ for supporting heavy or large tower-like structures needed to carry a load, e.g., wind turbines, power lines, freeway signs, ski lifts, street lighting, and bridge supports including columns, abutments, retaining walls, and the like.

2. Description of Related Art

U.S. Pat. Nos. 5,586,417, 5,826,387, 6,672,823, 7,533,505, 7,618,217, 7,707,797, and 9,045,878, the disclosures of which are fully and expressly incorporated herein by reference, disclose post-tensioned concrete foundations for tower structures.

The foundation disclosed in the US '797 patent has a circular post-tensioned concrete cap set on or below the ground surface. The foundation supports a tower from the upper surface thereof, which tower is attached to the post-tensioned concrete cap by a series of circumferentially spaced tower anchor bolts. The tower anchor bolts extend upwardly through, and are nutted atop, a circular tower base flange at the bottom of the tower and extend downwardly through, and nutted below, an embedment ring near the bottom of the post-tensioned concrete cap. The tower anchor bolts are also sleeved and shielded so as to prevent the concrete from bonding to the anchor bolts. This structure allows the tower anchor bolts to be elongated and post-stressed between the tower base flange and the embedment ring to alleviate bolt cycling and fatigue and allow the tower anchor bolts to be removed and replaced for bolt remediation, extended fatigue life, and greater bolt strength capacity to allow larger improved structures to be supported by the foundation in the future.

The concrete foundation according to the US '878 patent has a cementitious foundation cap which resists supported tower overturn by utilizing a multitude of circumferentially spaced, post-tensioned helical anchors. Each of the post-tensioned helical anchors is in the nature of an elongated pipe structure, typically formed by multiple sections (lengths) of externally threaded pipe coupled together longitudinally by internally threaded pipe couplers with spaced helical discs assembled around the periphery thereof, which discs allow the lower portion of the helical anchor to be spin-drilled deep into the ground, as is known in the art. The upper end of each post-tensioned helical anchor includes a post-tensioning element, sometimes more simply referred to herein as a tensioning element, which extends upwardly through the concrete foundation cap once poured and cured. The helical anchors are thus capable of being post-tensioned against the top of the foundation cap after the cap has cured.

To this end, the tensioning portion at the upper end of the helical anchor (or tensioning element) is encased, preferably with a plastic sleeve or the like. The encasing ensures that the tensioning element of the helical anchor does not bond to or bear into the foundation concrete cap, thus allowing the helical anchor to be post-tensioned and pulled upwardly until the helical disc and skin friction resistance of the in-ground portion of the helical anchor, compared with the surrounding subsurface soils, equals the required tension applied to the helical anchor. The required post-tension applied to the tensioning element should exceed the maximum uplift load determined for each helical anchor. Therefore, unlike conventional helical anchors, the helical anchors of the US '878 patent are post-tensioned anchors resisting overturn uplift.

Also, according to the US 878 patent, the lower portion (in-ground) of each post-tensioned helical anchor has one or more grout holes in the wall of the anchor couplers. And, once the helical anchor has been positioned into the ground, grout can be injected under pressure into the top of the helical anchor at the ground surface to fill the interior of the pipe sections and pipe couplers and be forced out through the coupler grout holes into the surrounding soil, thus forming bulbs of grout around the helical anchor at the grout holes.

Nevertheless, helical anchors according to the US '878 patent have some limitations. Specifically, the grout configurations created by the pressure grouting according to the U.S. '878 patent, i.e., after the helical anchor is drilled to depth, are not well distributed around the helical anchor, but rather are concentrated at each of the grout holes in the anchor coupler walls. Further, once drilled into the ground, the helical anchors according to the US '878 patent cannot be removed or even partly removed (reversed out), for repair or replacement, i.e., reversing rotation of the helical anchor will result in sections of pipe backing (unscrewing) out of the anchor couplers.

SUMMARY OF THE INVENTION

In order to overcome the aforesaid limitations, the present invention provides a helical anchor which can be simultaneously spin drilled and pressure grouted into the ground, which pressure grouted helical anchor provides a continuous grouting configuration inside the helical anchor and well distributed outside and around the helical anchor for its entire depth in the ground. The helical anchor includes a series of hollow pipe or bar sections (hereinafter "pipe sections") interconnected by helical pipe couplers. Each helical pipe coupler has an externally mounted disc and one or more grout holes in the coupler wall. A drill bit is rotationally secured to the bottom of the lowermost helical pipe coupler. Further in accordance with the present invention, the grouted helical anchor can be partly or completely removed and redrilled, as often as necessary.

In addition, the present invention provides a unique spin drilling and grouting assembly which can accomplish the simultaneous spin drilling and pressure grouting of the helical anchor into the ground, as well as the related equipment and components necessary for such simultaneous spin drilling and pressure grouting in order to achieve the requisite continuous grouting configuration well distributed outside and around the helical anchor for its entire depth into the ground. The present invention further provides a method for simultaneously spin drilling and pressure grouting the helical anchor into the ground.

In one embodiment, the pressure-grouted helical anchor of the present invention is utilized with a tensioning element which extends vertically upward, above the ground, through and above the top of a cementitious foundation cap, which tensioning element is secured to the top of the helical anchor adjacent the bottom of the cap and post-tensioned against the top of the cap. Such a concrete foundation utilizes multiple, circumferentially spaced, post-tensioned tensioning elements and pressure grouted helical anchors formed in accordance with the present invention. The post-tensioned concrete foundation thus produced is useful for supporting heavy or large tower-like structures needed to carry a load, e.g., wind turbines, power lines, freeway signs, ski lifts, street lighting, bridge supports including columns, abutments, and retaining walls, and the like.

The unique spin drilling and grouting assembly of the present invention includes a grout body having an internal cylindrical space, a grout port extending through a wall of the body in fluid communication with the internal space, and a locater plate projecting outwardly from the body for securing the grout body rotationally in place. Positioned within the internal cylindrical space in a freely rotating manner is a hollow cylindrical grout shank having a top and a bottom, at least one grout hole, and an interior open space. When the hollow cylindrical grout shank is rotated within the grout body, the at least one grout hole of the grout shank aligns with the grout port of the grout body once every complete (360°) rotation of the grout shank. As such, pressurized grout when fed into the grout port is forced through the at least one grout hole into the interior of the grout shank when the at least one grout hole aligns with the grout port. The bottom of the grout shank is configured to be rotationally secured (i.e., securing against rotating independently of) to the top end of a hollow pipe coupler, and the top of the grout shank is configured to be rotationally secured to the bottom end of a hollow torque drive connection coupler capable of being rotationally secured to a torque motor drive.

Preferably, there are more than one grout hole in the wall of the grout shank which align with the grout port upon rotation of the grout shank. Any plurality of grout holes should be equally spaced around the grout shank and, most preferably, there are four such grout holes spaced approximately 90° from each other.

In one aspect of the present invention, an apparatus for spin drilling and grouting a helical anchor into the ground is provided. The upper end of the grout shank of the spin drilling and grouting assembly is rotationally connected to a torque motor through opposing ends of a hollow torque drive connection coupler. A stop-type pipe coupler having a smooth bore end and an opposing threaded bore end has the smooth bore end rotationally secured to the bottom end of the grout shank and the opposing threaded bore end rotationally secured to a helical pipe anchor. Preferably, the grout holes are present only in the walls of the helical stop-type pipe couplers, i.e., there are no grout holes in the pipe sections, since the pipe sections can be relatively thin such that grout holes therein could unacceptably weaken the tensile strength of the pipe sections and therefore the helical anchor.

Another aspect of the present invention provides a method for spin drilling and grouting the helical anchor into the ground. The method includes spin drilling a helical anchor as described above into the ground to a depth while simultaneously forcing grout under continuous pressure into the top of the helical anchor such that grout exits grout holes in the helical anchor below ground level to form a grout column in the ground surrounding the anchor from the ground surface or bottom of the foundation to the depth to which the anchor is spin drilled, thereby forming an internally and externally continuous grouted helical anchor.

In another aspect, the present invention provides a post-tensioned grouted helical anchor having upper and lower portions. The lower portion includes the internally and externally grouted helical anchor as described above, and the upper portion includes a sleeved tensioning element extending upwardly from the top of the helical anchor, and through and above a cementitious foundation cap or other supported foundation. The top of the sleeved tensioning element extending above the foundation is externally threaded, nutted, and post-tensioned against the top of the foundation.

Accordingly, it is an object of the present invention to provide an assembly and method of simultaneously spin drilling and pressure grouting a helical anchor into the ground to create a continuous grouting configuration well distributed around the helical anchor for its entire depth in the ground.

It is another object of the present invention to provide a grouted helical anchor in accordance with the preceding object which can be partially or completely removed as desired.

It is a further object of the present invention to provide a pressure-grouted helical anchor together with a tensioning element extending vertically upward, above the ground, through and above the top of a cementitious foundation cap or other cementitious foundation structure, which tensioning element is secured adjacent the bottom of the foundation and post-tensioned against the top of the foundation.

It is still another object of the present invention to provide a concrete foundation in accordance with the preceding object in which multiple, circumferentially spaced, post-tensioned, grout-filled helical anchors and tensioning elements are utilized for supporting heavy or large tower like structures, such as wind turbines, power lines, three-way signs, ski lifts, street lighting, bridge supports including columns, abutments, and retaining walls, and the like.

It is still a further object of the present invention to provide a unique spin drilling and grouting assembly which includes a generally cylindrical grout body surrounding a freely rotating hollow cylindrical grout shank, the grout body having a grout port extending through a wall thereof and the grout shank having at least one grout hole such that when the hollow cylindrical grout shank is rotated within the grout body, the at least one grout hole of the grout shank aligns with the grout port once every complete rotation of the grout shank so that when pressurized grout is fed into the grout port, it is forced through the at least one grout hole into the interior of the grout shank.

It is still yet another object of the present invention to provide an apparatus for spin drilling and grouting a helical anchor into the ground which includes a torque motor rotationally connected to the unique spin drilling and grouting assembly, which in turn is rotationally secured to a helical anchor, wherein the helical anchor includes a series of hollow pipe or bar sections ("pipe sections") interconnected by helical couplers with one or more grout holes therein, the helical anchor having a drill bit secured to the lowermost end for spin drilling the helical anchor into the ground and simultaneously grouting the helical anchor and the soil around the helical anchor.

It is still yet a further object of the present invention to provide a method of spin drilling and continuously grouting a helical anchor into the ground which includes spin drilling a helical anchor into the ground using the apparatus described in the previous paragraph to a depth while simultaneously forcing grout under continuous pressure into the top of the helical anchor through the grout hole of the grout body of the spin drilling and grouting assembly such that grout exits the grout holes in the helical pipe couplers below ground level to form a grout column in the ground surrounding the anchor from the ground surface or bottom of the foundation to the depth to which the anchor is spin drilled to thereby form an internally and externally continuous grouted helical anchor in the ground.

Still another object of the present invention is to provide capability to drill to depth, reverse drill partially, and redrill to depth as often as necessary to inject design quantities of grout into the surrounding soil.

The above together with other objects and advantages of the present invention which will become subsequently apparent reside in the details of construction and operation as more fully hereinafter disclosed and claimed, reference being had to the accompanying drawings forming a part hereof, wherein like numerals refer to like parts throughout.

DETAILED DESCRIPTION OF THE PREFERRED EMBODIMENTS

Figure 1:
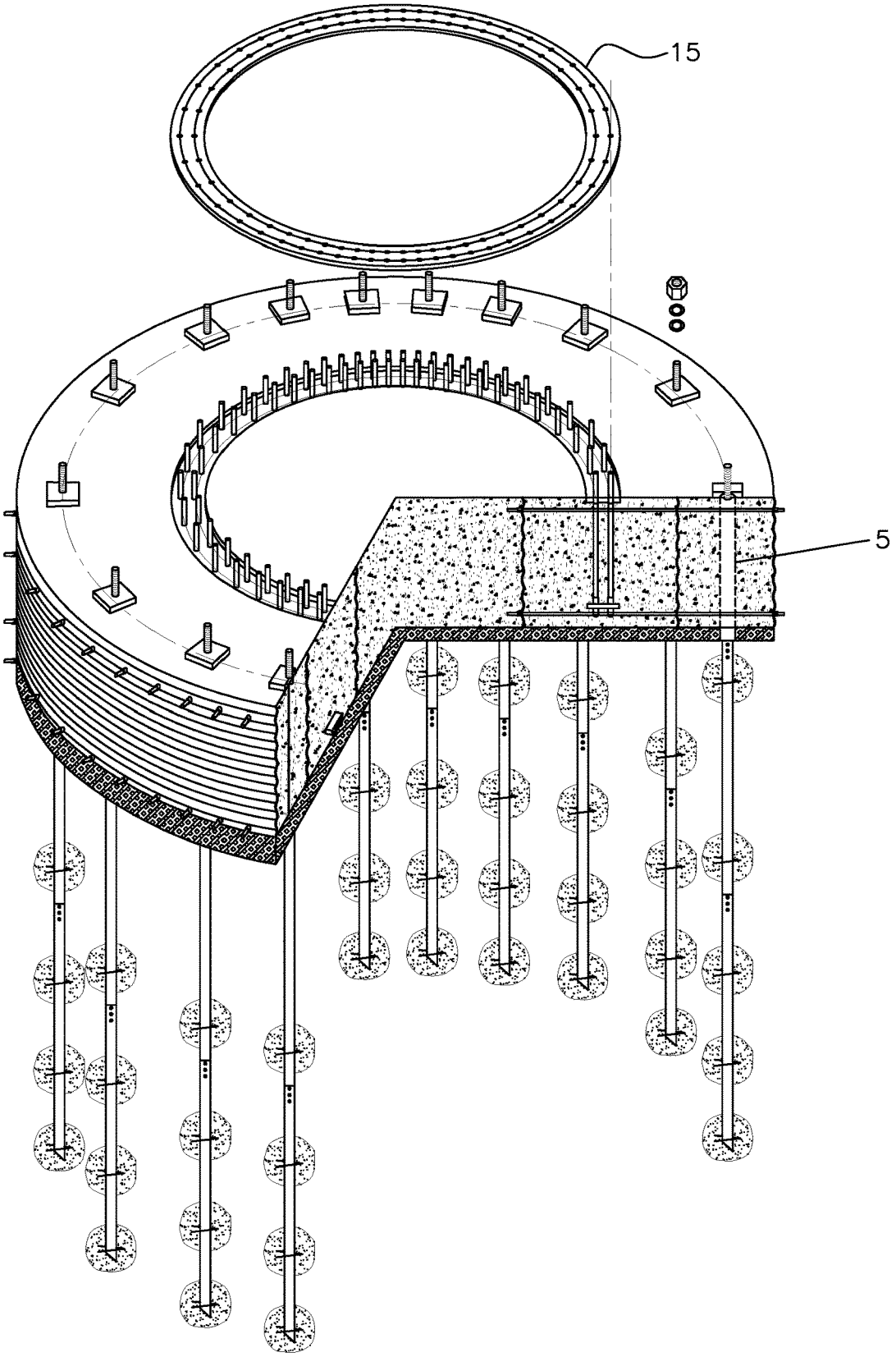
FIG. 1 PRIOR ART
FIG. 1 is a perspective view, partially in section, of a completed concrete foundation with post-tensioned helical anchors and foundation cap constructed in accordance with the US '878 patent and labelled "Prior Art".

Although preferred embodiments of the present invention are explained in detail, it is to be understood that the embodiments are provided for illustration only. It is not intended that the invention be limited in scope to the details of structure or arrangement of components set forth in the present description or illustrated in the drawings. Also, in describing the preferred embodiments, specific terminology will be resorted to for the sake of clarity. It is to be understood that each specific term includes all technical equivalents which operate in a similar manner to accomplish a similar purpose.

Figure 9:
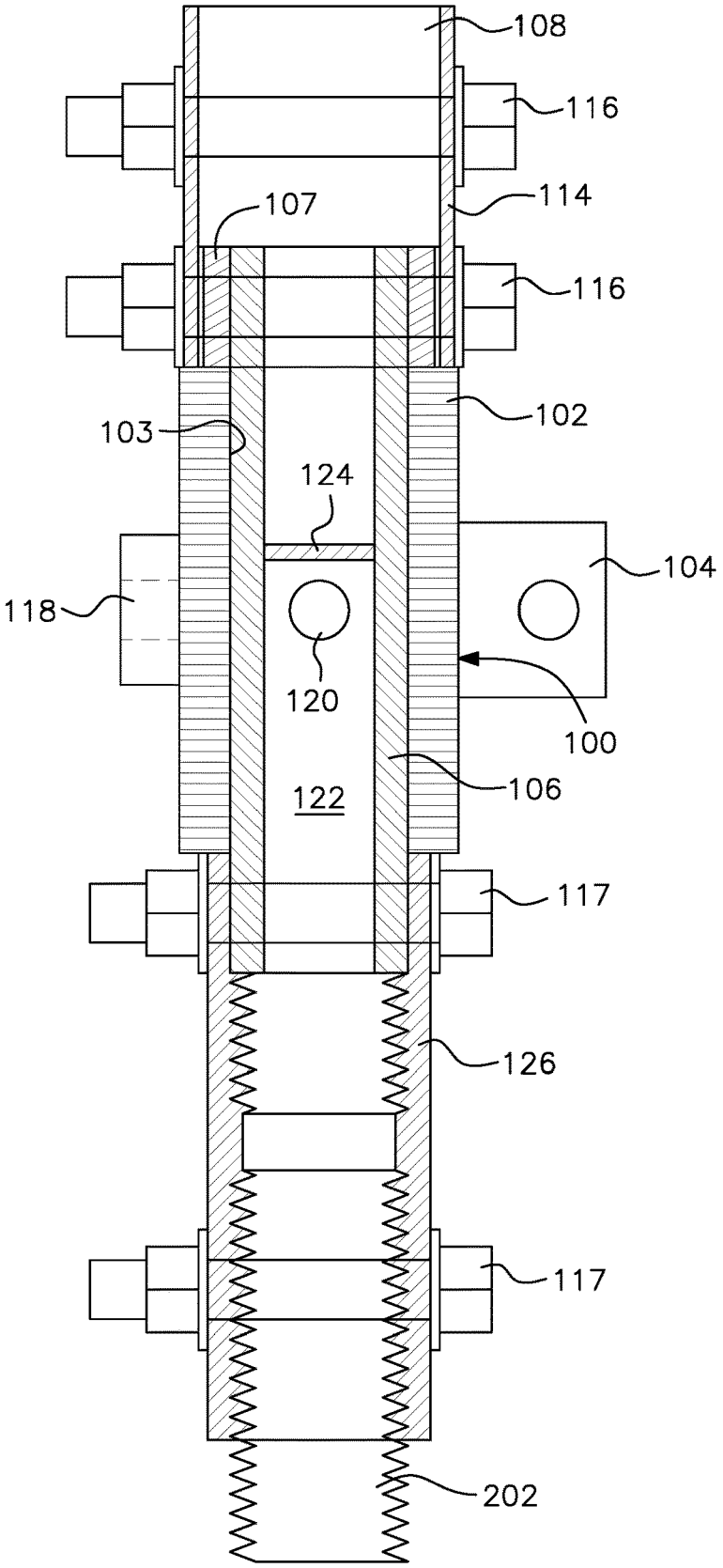
FIG. 9 is a cross sectional view of a preferred embodiment of the spin drilling and grouting assembly in accordance with the present invention connected at its top to a torque drive connection coupler and at its bottom to an anchor pipe coupler, or a stop type coupler, which in turn is connected to the threaded top of a pipe section, according to the present invention.
Figure 10:
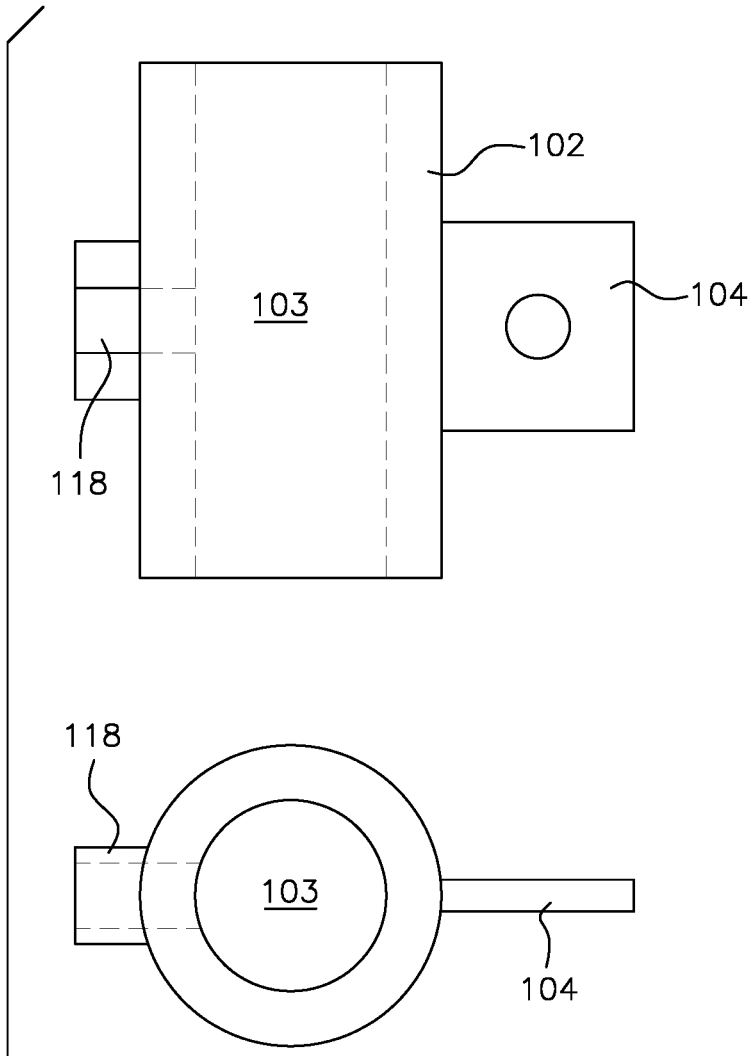
FIG. 10 shows a side view and a top view of the grout body of the spin drilling and grouting assembly shown in FIG. 9.
Figure 11:
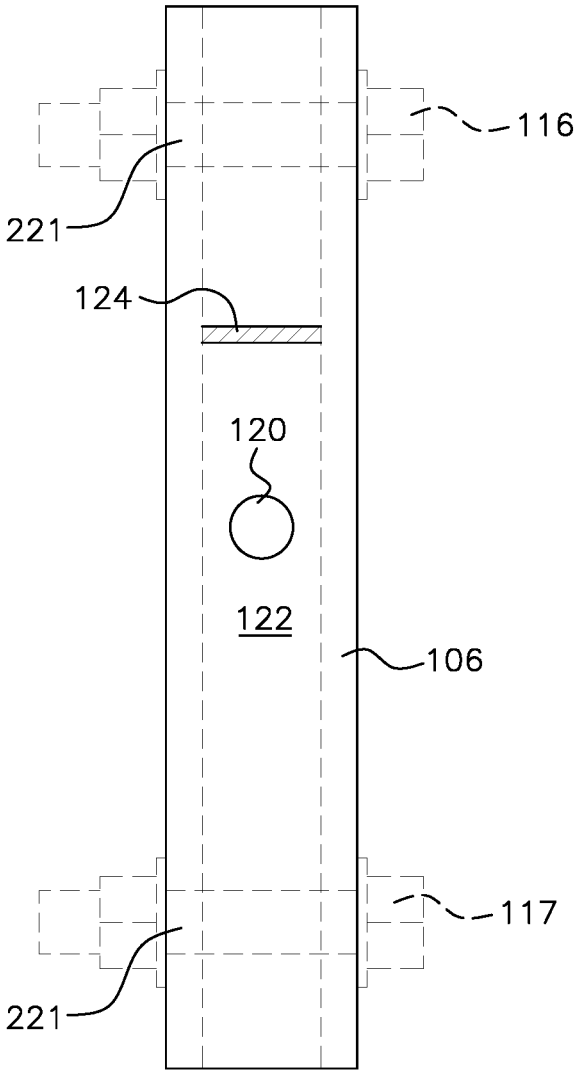
FIG. 11 is a cross sectional view of the grout shank of the spin drilling and grouting assembly shown in FIG. 9.
Figure 12:
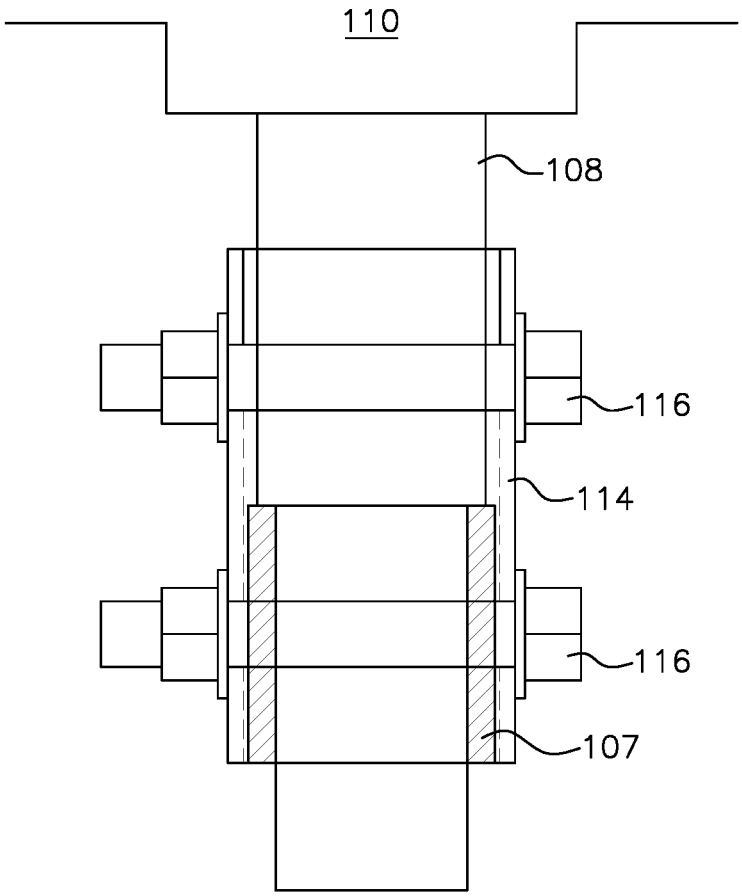
FIG. 12 is a cross sectional view of the torque drive connection coupler shown in FIG. 9 and also showing its connection at its top to the output shaft of the torque motor and at its bottom to the pipe sleeve of the spin drilling and grouting assembly of the present invention.

An important component of the post-tensioned, grouted helical anchor assembly and method of the present invention is the unique spin drilling and grouting assembly illustrated in FIG. 9 and generally designated by reference numeral 100. The assembly 100 incudes a grout body 102, as illustrated in FIG. 10, which has a longitudinal internal cylindrical space 103 open top and bottom. The grout body 102 is held in place by locator plate 104. Rotationally positioned in the cylindrical space 103 of the grout body 102 is a hollow grout shank 106, as illustrated in FIG. 11. As shown in FIG. 9, the outer wall of grout shank 106 rotationally engages against the cylindrical inner wall of grout body 102, and upper and lower O-ring gaskets or other sealing mechanisms serve to seal the flow of grout into the spin drilling and grouting assembly 100. For rotation, the hollow grout shank 106 is connected to output shaft 108 of a torque motor 110 through pipe sleeve 107, which surrounds the upper end of grout shank 106, and pipe coupler 114 (also see FIG. 12). Upper and lower shear pin bolts 116 rigidify the connection between the grout shank 106 and the torque motor shaft 108.

The grout body 102 includes an inlet grout port 118 through which pressurized grout is injected into the assembly 100. Vertically aligned with the grout port 118 are one or more grout holes 120 in the grout shank 106. Preferably, there are four of such grout holes 120, each separated by 90°, horizontally spaced around the circumference of the grout shank 106.

As the torque motor 110 turns (rotates) the hollow grout shank 106 inside the grout body 102 (fixed in position), while pressurized grout is injected into the grout body through the grout port 118, pressurized grout enters the interior 122 of the grout shank 106 as each grout hole 120 in the rotating grout shank 106 aligns with the grout port 118. Thus, if the torque motor 110 rotates the output shaft 108 and connected hollow grout shank 106 at a speed of 10 revolutions per minute (RPM) and there is only one grout hole 120, the grout hole 120 aligns with the inlet grout port 118 a total of 10 times per minute. On the other hand, if there are the four grout holes 120 around the circumference of the grout shank 106, as preferred in accordance with the present invention, then the grout holes 120 align with the inlet grout torque 118, 40 times per minute.

Once the pressurized grout has been forced into the interior 122 of the hollow grout shank 106 through the port holes 120, the pressurized grout is prevented from rising upwardly in the hollow grout shank 106 by grout plug 124 positioned above the grout hole or holes 120. As such, the pressurized grout is forced downwardly toward the top of the pipe section 202. As shown in FIG. 9, the bottom of the grout shank 106 is rotationally secured to a coupler 126, which in turn is rotationally secured to the top of pipe section 202 with upper and lower shear pin bolts 117. Accordingly, when driven by the torque motor 110, the hollow grout shank 106 of the spin drilling and grouting assembly 100 can spin drill pipe section 202 into subsurface soils, while at the same time continuously forcing pressurized grout into the interior of the pipe section 202.

Figure 4:
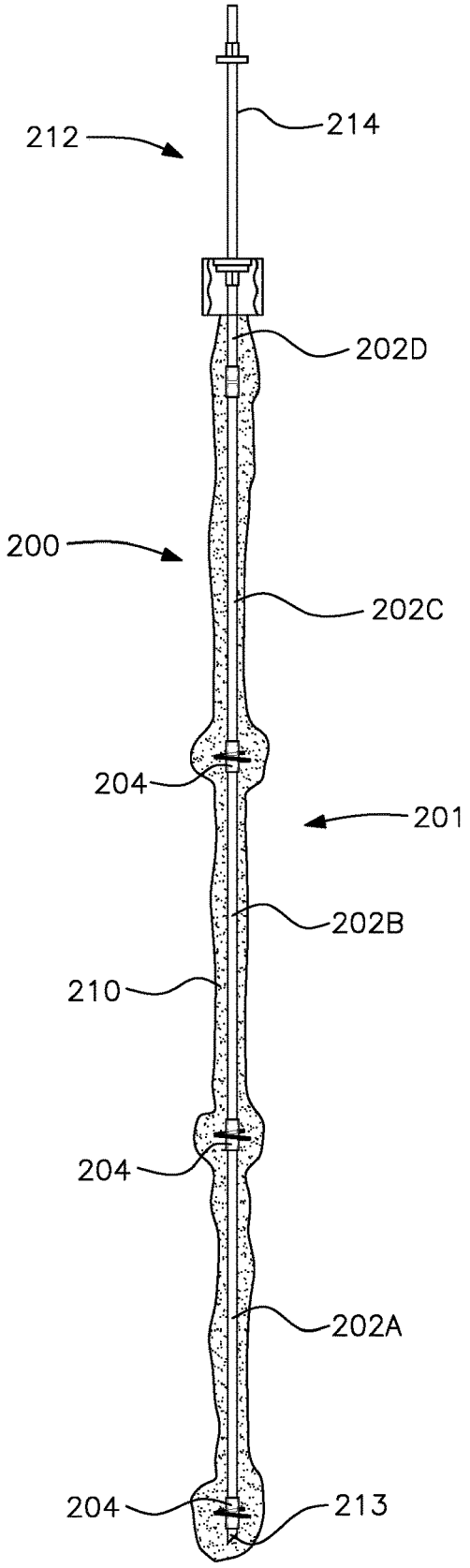
FIG. 4 is an overall side view an ungrouted tensioning element positioned above a pressure-grouted helical anchor in accordance with the present invention as shown in FIGS. 2 and 3, including a representative illustration of the continuous grout column surrounding the helical anchor.
Figure 14:
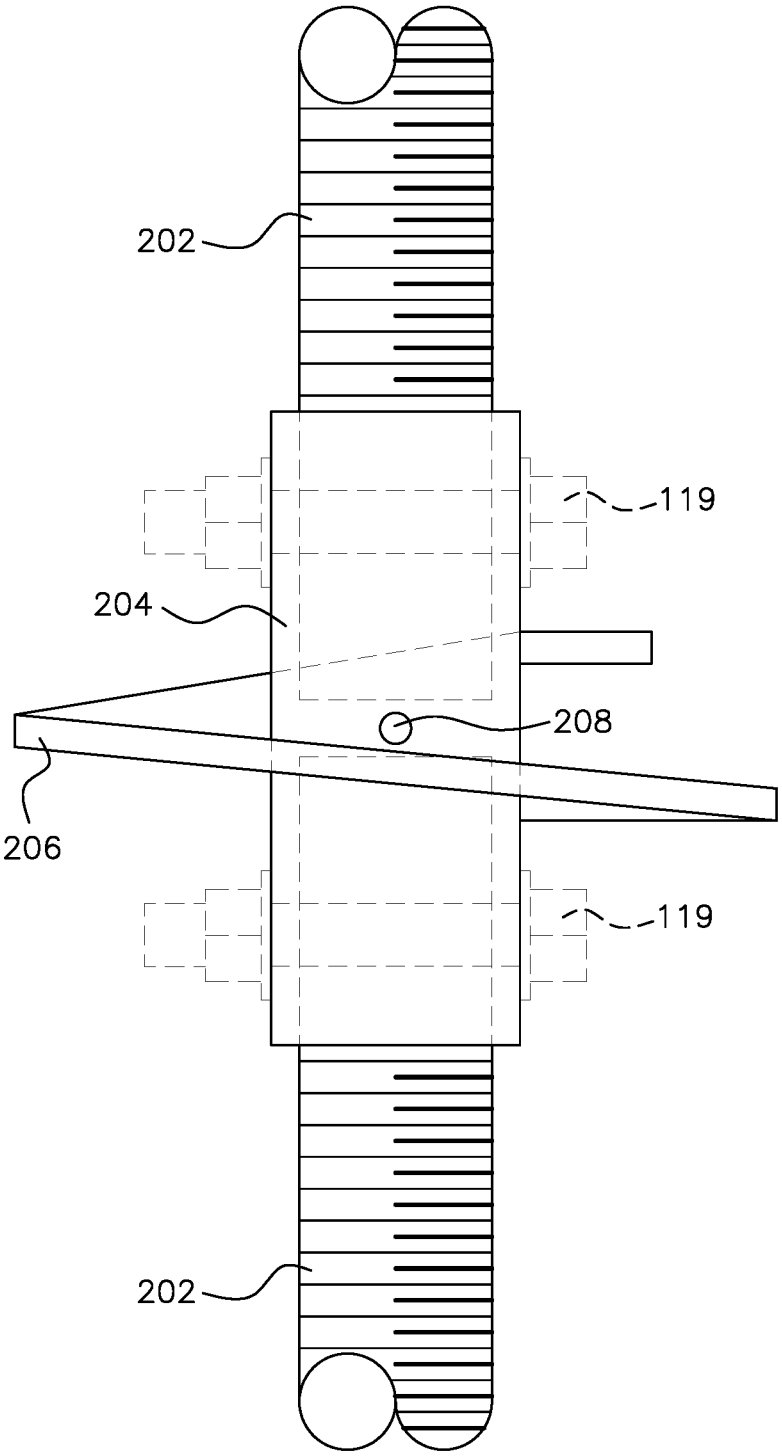
FIG. 14 is a side view of an internally threaded helical anchor coupler joining two externally threaded pipe sections with shear pin holes to accommodate shear pins for rotationally securing together the two pipe sections and showing a grout hole in the coupler wall, in accordance with the present invention.

A complete pressure-grouted helical anchor in accordance with the present invention together with a tensioning element is illustrated in FIG. 4, after the helical anchor has been spin drilled and pressure-grouted into the ground and the tensioning element above has been rigidly assembled vertically atop the anchor, and together the assembly is generally designated by reference numeral 200. The helical anchor, generally designated by reference numeral 201, is in the nature of an elongated pipe consisting of a series of hollow pipe sections 202 (individually identified by numerals 202A, 202B, 202C and 202D) interconnected by helical pipe couplers 204 to form the helical anchor 201. Each pipe coupler 204 preferably has a helical disk 206 assembled around its periphery (also see FIG. 14) and also includes at least one grout hole 208, which allows the pressurized grout passing down the interior of the helical anchor 201 to exit into the surrounding soil as the helical anchor is spin drilled into the ground. Connected to the bottom of the lowermost pipe coupler 204 is drill bit 213. Thus, a continuous grout column 210 is created as each successive pipe section 202 is separately spin drilled into the ground by rotation of the motor shaft 108 and grout shank 106. As the continuous grout column 210 is created while each pipe section 202 of the helical anchor 201 is being spin drilled into the ground, the soil surrounding the helical anchor is compressed, as the anchor is spin drilled and grouted to anchor depth into the soil.

Figure 2:
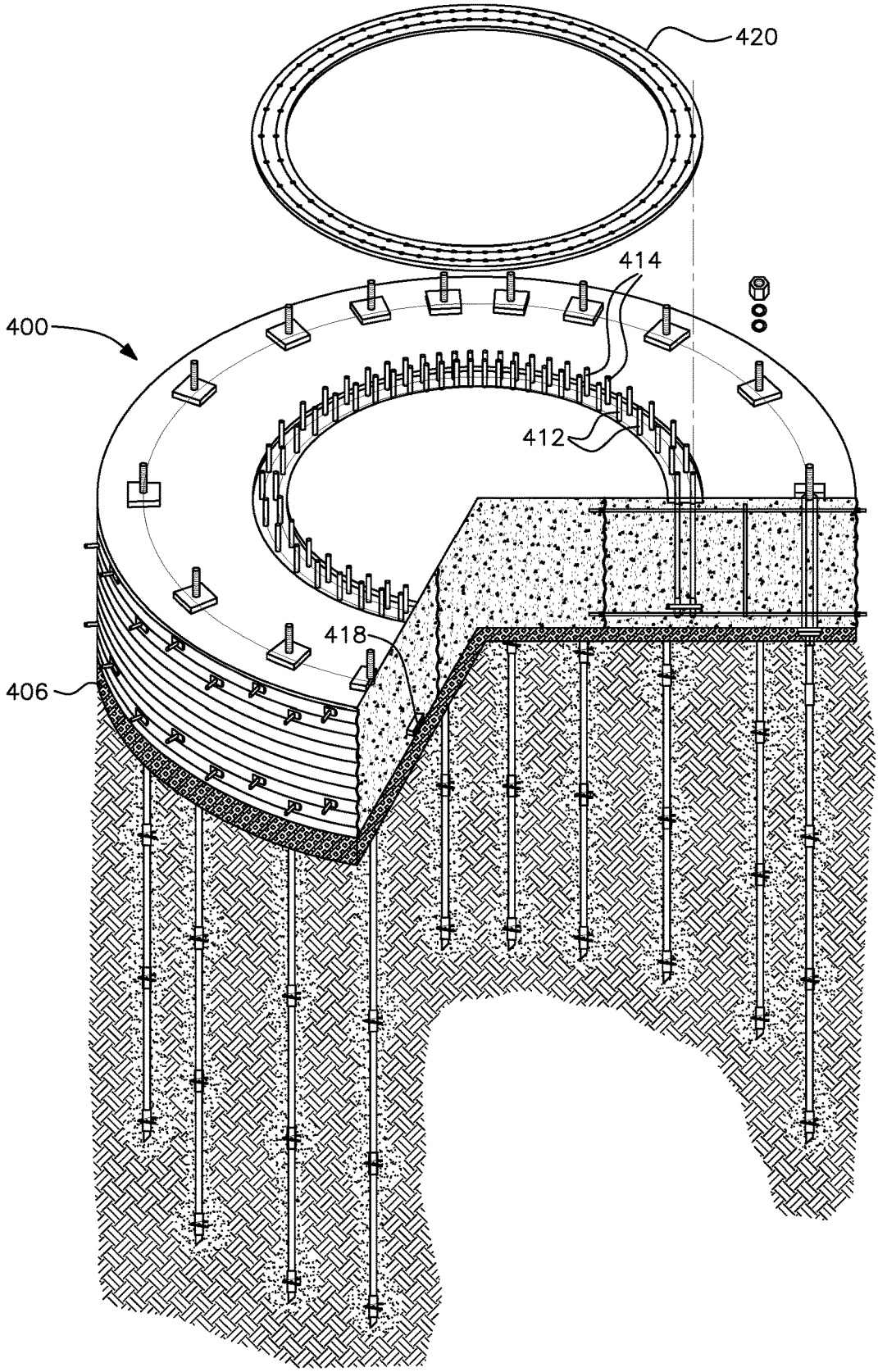
FIG. 2 is a perspective view, partially in section, of a completed concrete foundation with tensioning elements, pressure-grouted helical anchors and foundation cap constructed in accordance with one embodiment of the present invention.
Figure 3:
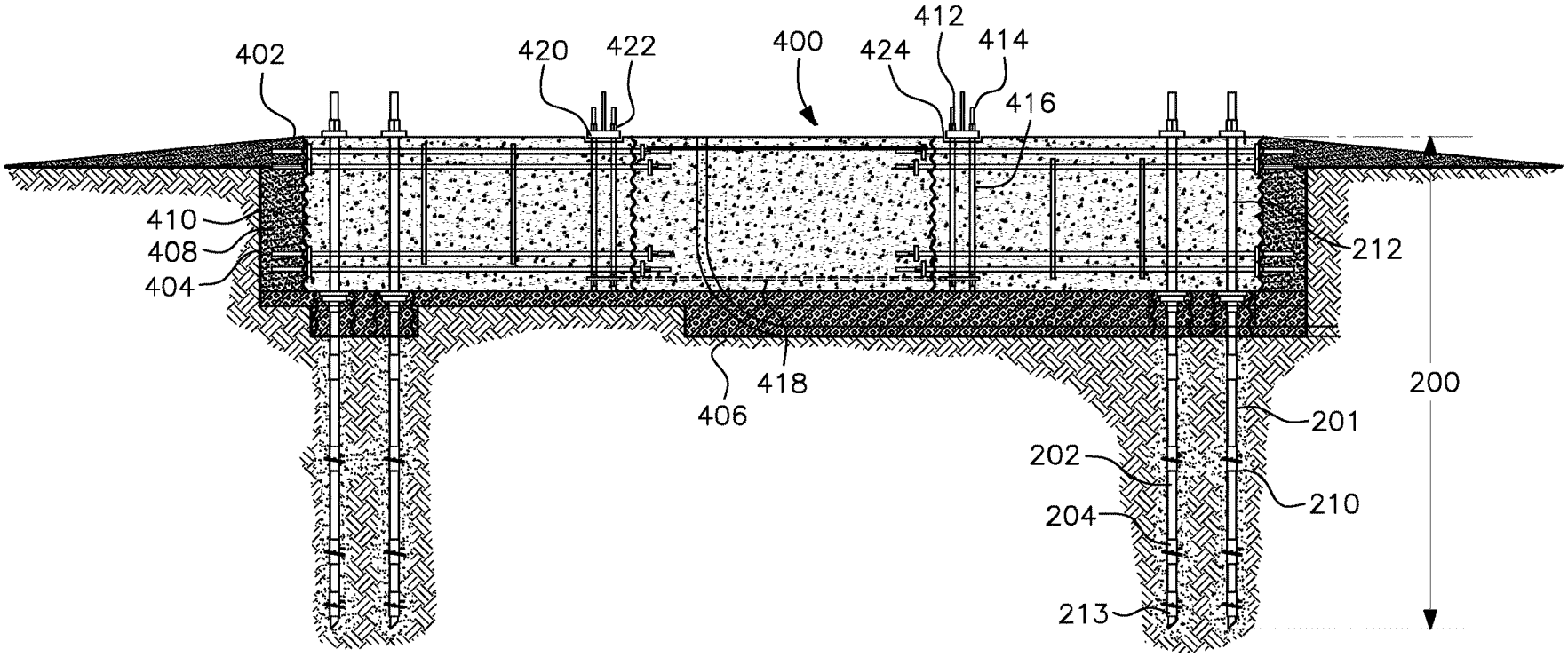
FIG. 3 is a sectional view of the tensioning elements, pressure-grouted helical anchors and post-tensioned foundation cap as shown in FIG. 2 with a tower base flange set in the grout trough of the cap, and showing four tensioning elements extending above respective pressure-grouted helical anchors in accordance with the present invention.

As described above, the helical anchor 201 has grout holes 208 in the couplers 204 connecting pipe sections 202. Grout is emitted simultaneously and continuously through the holes 208 as the pipe sections are spin drilled into subsurface soils surrounding the helical anchor. Cementitious material 210 comprising the perimeter can be increased by reverse spin removing portions of the anchor 201 and redrilling and regrouting to depth. The tensioning element, generally designated by reference numeral 212, which is encased with a plastic sleeve 214, or like, as is known in the art, and the completed helical anchor 201 (after the grout has cured) can be post-tension against the top of the foundation cap 400 as shown in FIGS. 2 and 3. The sleeve 214 allows the steel of the tensioning element to move freely without bonding to the surrounding material (generally cementitious), thus allowing the post-tension upwind loads to elongate the tensioning element and pressure grouted helical anchor equal to the skin friction of the soil resisting the maximum uplift load which is a factored load greater than the design load. The tensioning element and helical anchor can be post-tensioned after the grout has cured by lifting upward by jacks or other similar equipment to elongate and nut off the anchor tensioning element, thus avoiding stress reversals and fatigue.

As shown in FIG. 4 and as described above, the pressure-grouted helical anchor 201 has at least one externally threaded pipe section 202 rotationally secured at its lower end to a drill bit by a helical, pipe coupler 204 that is internally threaded at both ends, has an externally mounted helical disc 206 (or multiple helical discs), and has one or more grout holes 208 through the coupler wall. As also described above, the pressure-grouted helical anchor 201 comprises sections of hollow pipe 202 coupled together by helical pipe couplers 204 for the length of the helical anchor required. The number of pipe sections and interconnecting helical pipe couplers is determined by engineering analysis. As shown representatively in FIGS. 2, 3 and 4, there are four pipe sections 202 and four pipe couplers 204, with drill bit 213 assembled onto the bottom of the lower most pipe coupler. The pipe couplers 204 are stop-type couplers and can have grout holes, helical discs, shear pins, grout plugs, and associated drill bits as required.

While drill bit 213 is shown in the patent drawings as a shortened pipe having an angled lower end (see FIGS. 2-6), those skilled in the art will readily recognize that any commercial drill bit suitable for spin drilling a helical anchor into the ground can be used in accordance with the present invention.

It is possible that the pipe sections 202 can include grout holes in the pipe wall and one or more helical discs externally mounted around the pipe section. However, grout holes (and helical discs) are preferably excluded from the pipe section itself, as the pipe walls are preferably relatively thin such that even one grout hole in the pipe wall reduces the tensile strength of the pipe section, and so, the entire helical anchor. There is no corresponding loss of anchor tensile strength when the grout ports are formed through the wall of the pipe couplers 204, as the coupler wall has a greater thickness, and therefore greater strength, than the pipe section wall. Similarly, the couplers 204 are best suited for mounting of the helical discs 204 in view of the torque imposed thereon during the spin drilling of the helical anchor 201 into the ground, and can be more readily installed on the relatively short pipe couplers 204, rather than the elongated pipe sections 202.

The overall procedure for simultaneously spin drilling and continuously grouting a helical anchor 201 into the ground is illustrated in FIGS. 5-8. Starting with FIG. 5, there is schematically illustrated boom 302 supported from a track excavator or backhoe 304. Supported on the lower end of boom 302 is drive motor 110, the shaft 108 of which is connected to and drives the spin drive and grouting assembly 100, which in turn supports and is connected to the top end of and drives a first pipe section 202A, with drill bit 213 connected at its lower end by pipe coupler 204. Connected to the spin drill and grouting assembly 100 is a grout hose 306 for delivering pressurized grout from a pressure grout pump 308, or other source for pressurized grout, to assembly 100.

Figure 5:
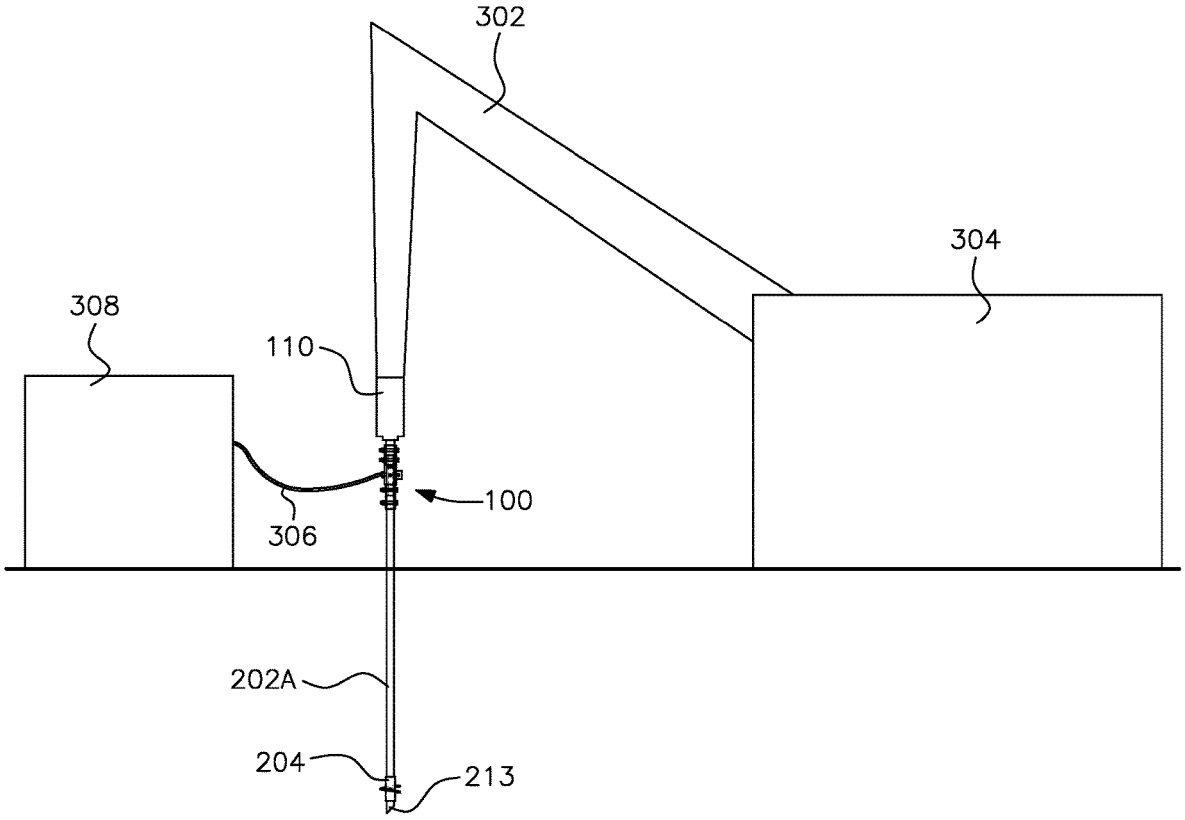
FIG. 5 is a schematic side view illustrating a beginning of the installation of a pressure grouted helical anchor in accordance with the present invention, with a first pipe section, helical pipe coupler and drill bit having been partially spin drilled into the ground while grout is being continuously pumped into the pipe section through the spin drilling and grouting assembly.
Figure 6:
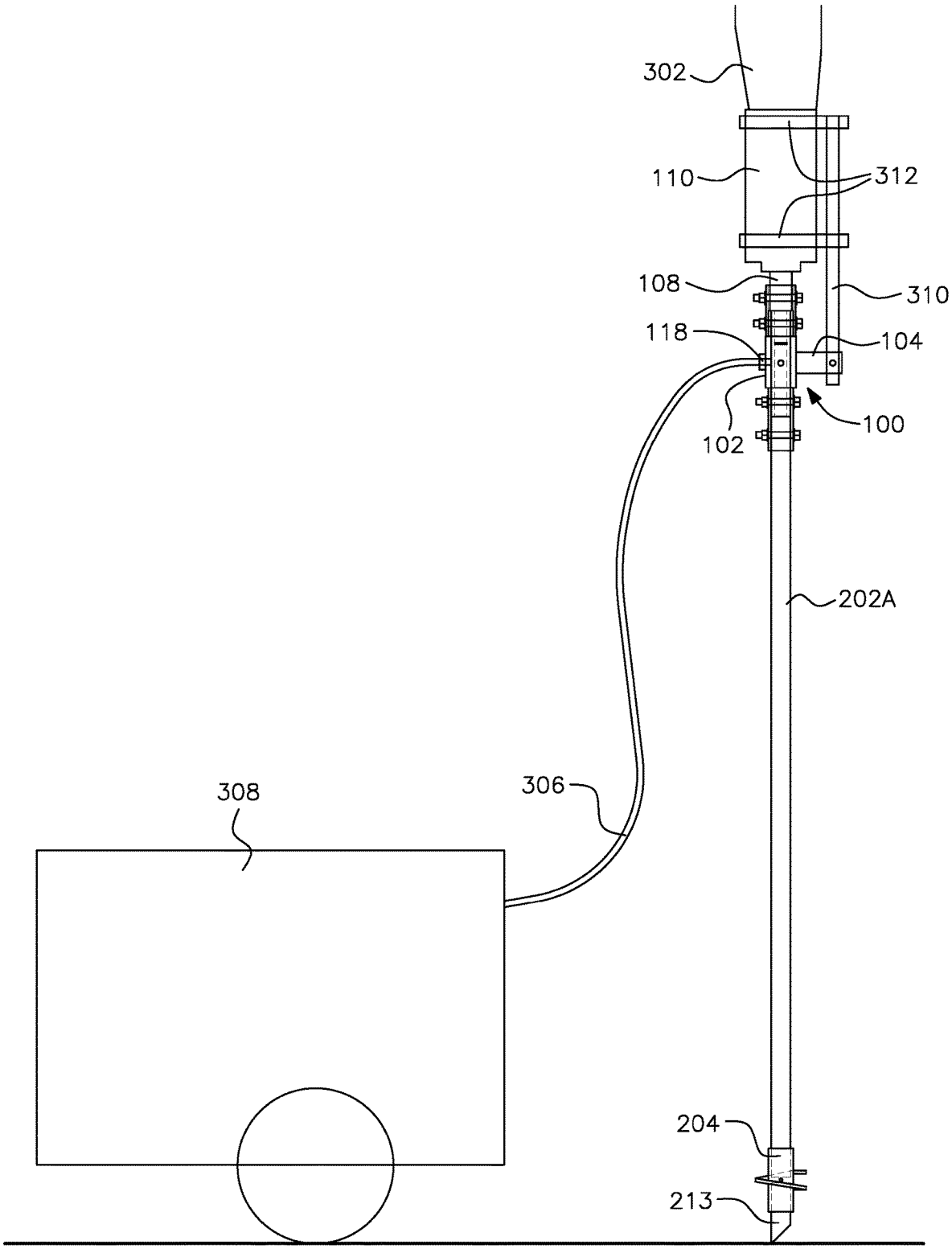
FIG. 6 is another schematic side view similar to FIG. 5 (but enlarged) illustrating the first pipe section, helical piper coupler and drill bit before being spin drilled into the ground in accordance with the present invention.

Turning next to FIG. 6, there is shown schematically some of the relevant components shown in FIG. 5, but in an enlarged view. As shown in FIG. 6, the grout hose 306 feeds the pressurized grout from pressure grout pump 308 into inlet grout port 118 of the spin drilling and grouting assembly 100. Locator plate 104 is shown holding the grout body 102 of the spin drilling and grouting assembly 100 in place (against rotation) by vertical bracket 310 and straps 312 rigidly mounted on motor 110.

Figure 7:
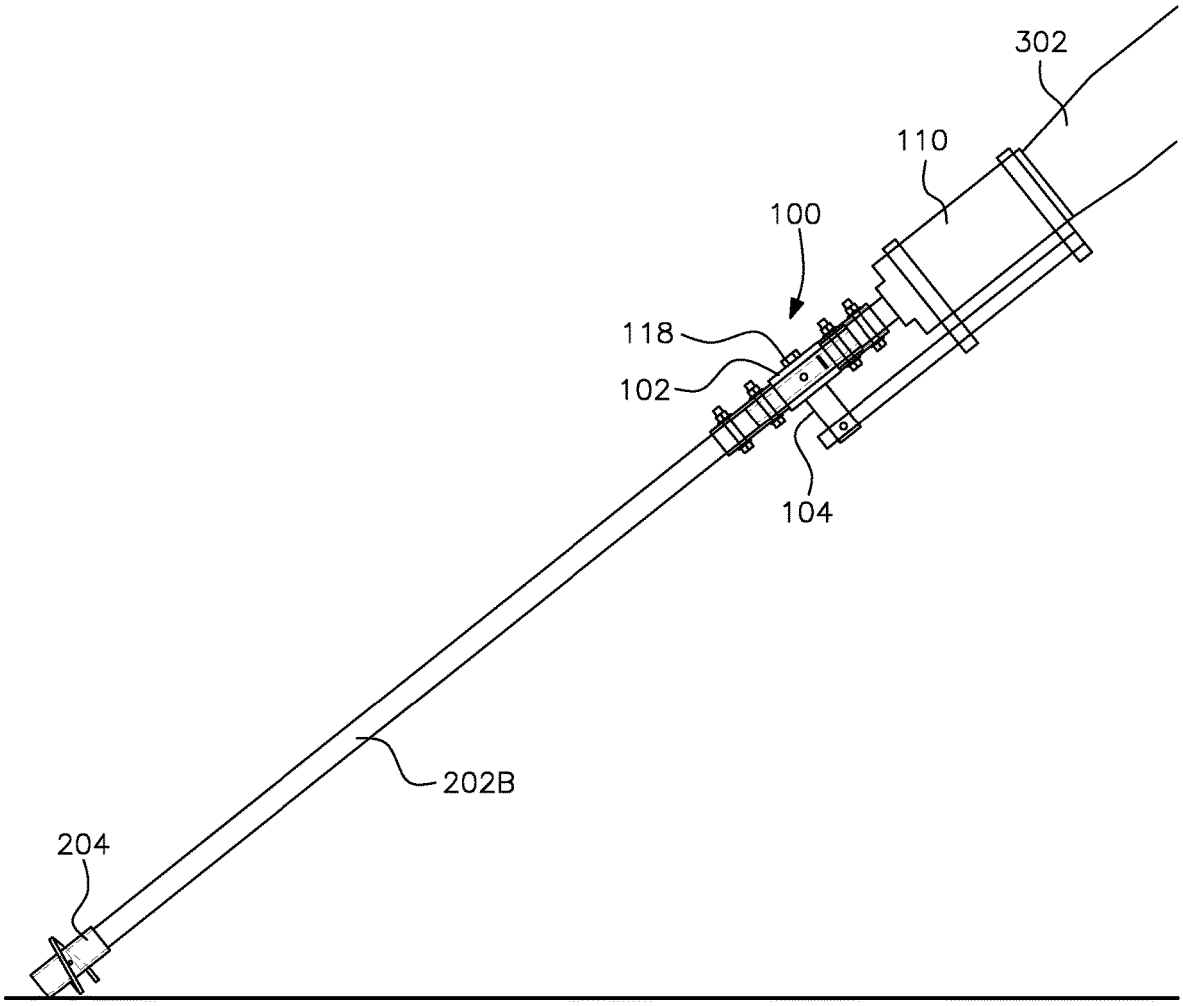
FIG. 7 is a schematic side view of a second pipe section and a second helical pipe coupler of a helical anchor at an angle of about 45° to ground level before being assembled with the first pipe section shown in FIG. 5.

FIG. 7 shows some of the same components shown in FIGS. 5 and 6, except a second pipe section 202B is connected at its top to the spin drilling and grouting assembly 100, and a new pipe coupler 204 is assembled on the lower end of section 202B.

Figure 8:
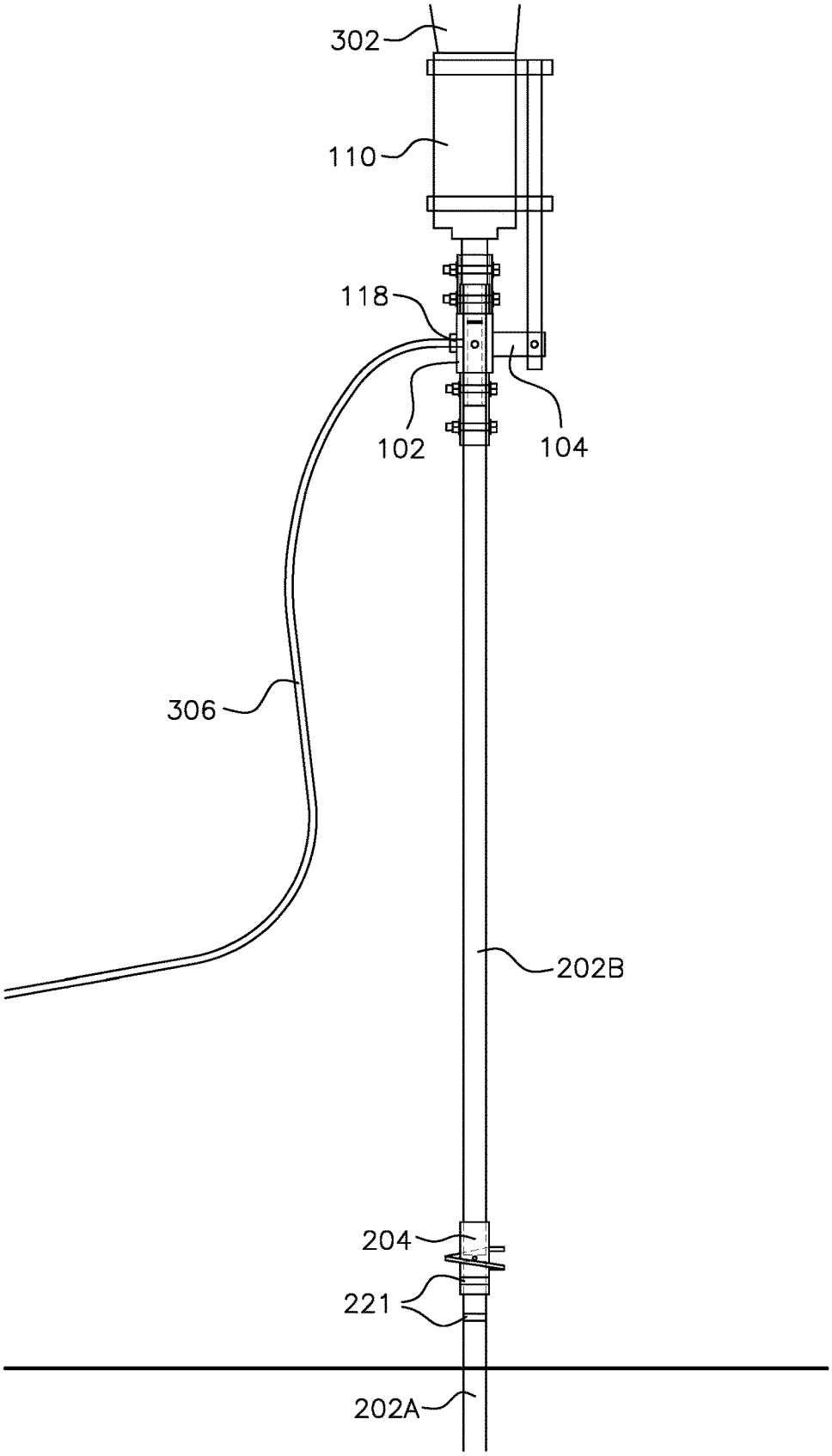
FIG. 8 is a schematic side view of the second pipe section of the helical anchor and related components as shown in FIG. 7, with the second pipe section and coupler raised to a vertical position immediately before spinning to engage the threaded bore at the bottom of the helical pipe coupler to the external threads at the top of the first pipe section already spin drilled and grouted into the ground.

FIG. 8 shows the same components shown in FIG. 7, except FIG. 8 also shows the grout hose 306 connected to the grout port 118 and the first helical anchor section 202A already spin drilled into the ground. As shown in FIG. 8, the second pipe section 202B is ready to be loaded with grout through grout hose 306 and into the spin drilling and grouting assembly 100 through grout port 118, as the second pipe section 202B is hung vertically from motor 110 and evacuator or back hoe boom 302, and pipe coupler 204 at the lower end of the second pipe section 202B is about to be assembled onto the upper threaded end of the first pipe section 202A. Once the lower end of pipe coupler 204 has been threaded onto the top of pipe section 202A, and a shear pin assembled into aligned bolt holes 221, the spin drilling of pipe section 202B can begin as both pipe sections 202B and 202A are spin drilled to a further depth into the ground. At the same time, pressurized grout is being fed into the spin drilling and pressure grouting assembly 100 through grout holes 120 which, in turn, forces grout out of the grout holes 208 in helical pipe couplers 204 thus continuing to form the continuous external grout column 210 during the spin drilling operation. In a similar manner, additional pipe sections, such as sections 202C and 202D and associated helical pipe couplers 204, are assembled, spin drilled into the ground and simultaneously grouted so that the continuous grout column 210 can ultimately be formed as shown in FIG. 4.

As described above, each helical anchor 201 is spin drilled into subsurface soils to the desired anchor depth. The grout-filled pipe sections 202 are injected with grout under high pressure with simultaneous spin drilling to depth. The grout injection forces grout out of the helical anchor through grout holes 208 in the pipe couplers 204, which pressurized grout compresses surrounding soils and increases the anchor contact area with the soils once spin drilled to depth. Preferably, a final high pressure grout injection is made to maximize the grouting effect after the helical anchor 201 has been drilled to depth.

It will be noted that the spin drilling and grouting assembly 100 is reused to spin drill and pressure grout each pipe section 201 and associated pipe coupler 204, but then does not become a part of the tensioning element and helical anchor assembly 200, as shown in FIG. 4. Rather, assembly 100 is repeatedly reused as each helical anchor 201 is simultaneously spin drilled and pressure grouted in accordance with the present invention. Similarly, the tensioning element 212 in accordance with the present invention differs from the tensioning element of the US '878 patent. The tensioning element of the US '878 patent is filled with grout, whereas the tensioning element 212 in accordance with the present invention is not filled with grout. However, the aforementioned makes no difference. The tensioning element is a hollow bar pipe and the interior hollow portion may remain filled with grout with no impact on the tensioning element.

When constructing, project foundation helical anchors are to be installed after a test helical anchor is drilled at the site in the worst soil conditions and tested to PTI standards to verify that the anchors meet or exceed design requirements.

As described, the helical anchors are spin drilled by a torque motor 110 (electric or hydraulic) such as, e.g., Pro-Dig Model T20K Two Speed Drivehead available from Pro-Dig USA (Wathena, Kansas). The torque motor is attached to a backhoe or excavator arm 302 which provides versatility and simplifies helical anchor installation. If backhoe or excavator hydraulic torque motors are utilized, the backhoe or excavator may need two hydraulic pumps to operate the hydraulic drill and equipment arm at the same time.

The torque motor 110 has a drive extension with a through hole for connection and torque transfer to the spin drilling and grouting assembly 100 which attaches to the pipe sections 202.

Figure 15:
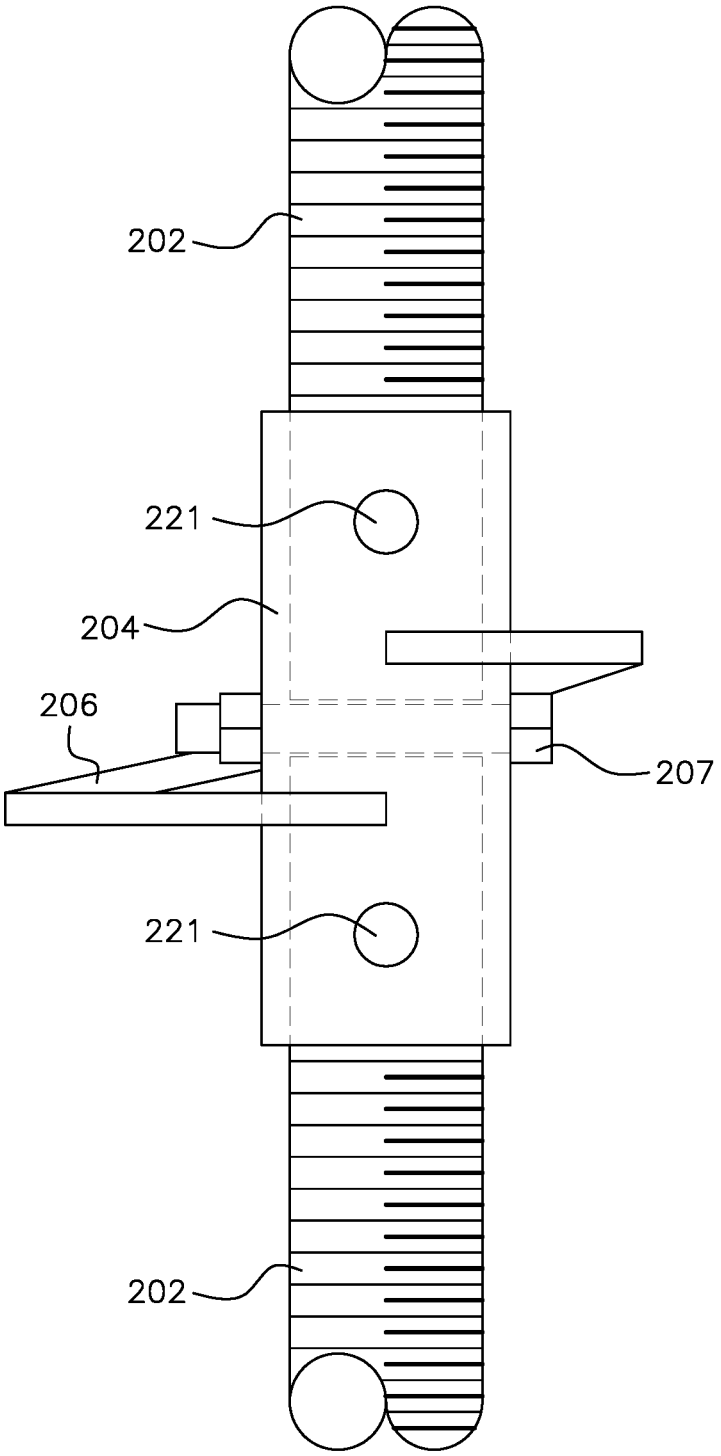
FIG. 15 is another side view of the helical pipe coupler joining two pipe sections as shown in FIG. 14, but rotated 90°, with shear pin holes for accommodating shear pins to rotationally secure the two pipe sections and further containing a grout hole plug through the coupler grout hole, if desired, in accordance with the present invention.
Figure 16:
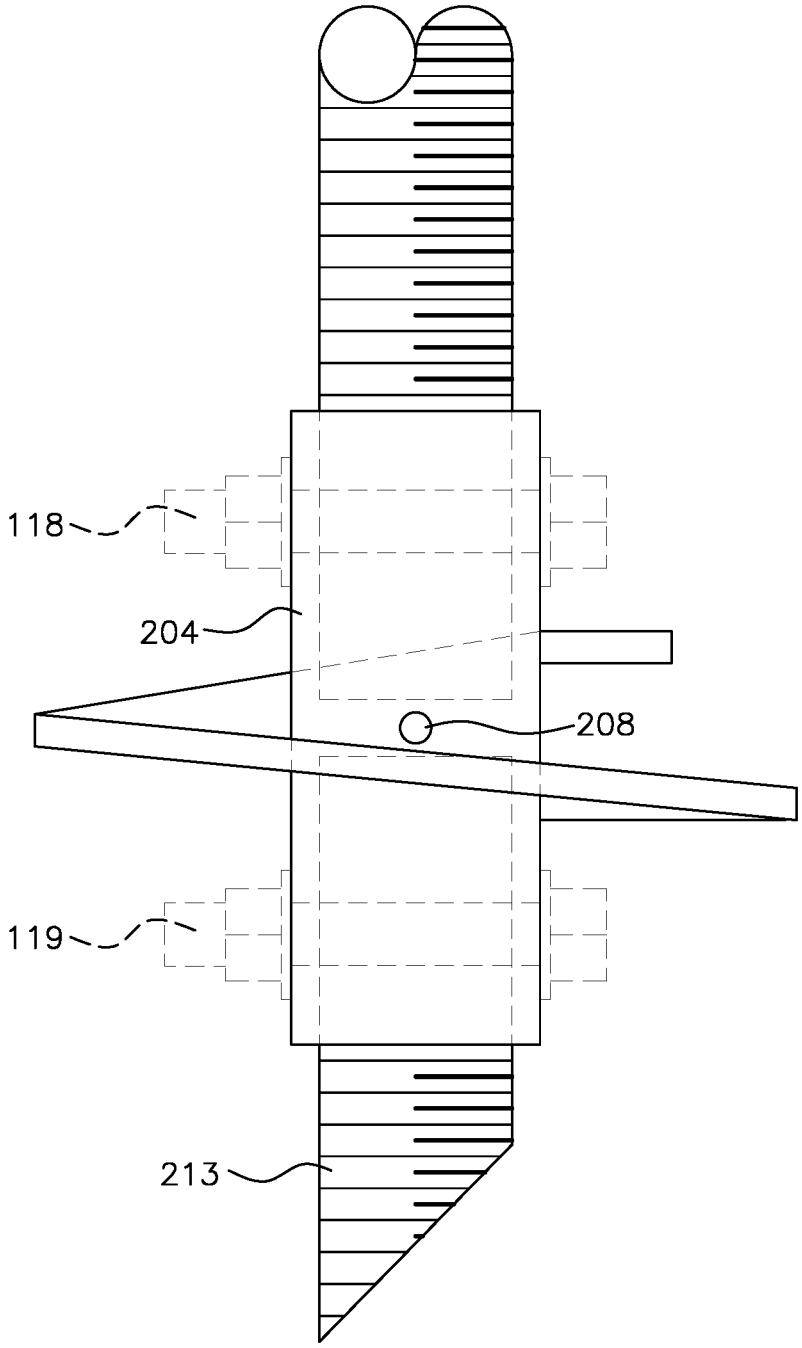
FIG. 16 is a side view of a helical anchor coupler connecting the lower most pipe section to a drill bit in accordance with the present invention, the coupler including shear pin holes for accommodating shear pins to rotationally secure the helical anchor coupler to the lower most pipe section and the drill bit.

The couplers 114, 126 and 204 and torque output shaft drive 108 have shear pins 116, 117 and 119 secured in shear pin holes 221 (shown in FIGS. 8, 11, and 15) to allow, if desired, reverse spin for removal of the helical anchor as required. The grout port hole 208 in any of the pipe couplers 204 can be closed off by a properly sized grout port plug 207, as shown in FIG. 15.

The spin drilling and grouting assembly 100 is assembled by sliding the top half of a smooth bore 4" pipe coupler 114 over the motor output drive shaft 108, aligning shear pin holes in the drive shaft and coupler, and inserting a ⅞" shear pin bolt 116 nutted with washer wrench tight. The 3" diameter×2" in length pipe sleeve 107 is then inserted into the bottom half of the 6" in length pipe coupler 114 and held in place with holes in the coupler in alignment with holes in the pipe sleeve. The 3 inch diameter grout shank 106, 12.06 inches in length, is then inserted 2 inches into the pipe sleeve (inside the coupler 114) with holes aligned so a ⅞ inch shear pin bolt 116 can be inserted through the holes in the shank, pipe sleeve, and pipe coupler. The shear pin bolt is nutted with washers at both ends wrench tight.

The grout body 102 with internal rubber ring gaskets at opposing ends (not shown) is pressed over the grout shank 106 to contact the long pipe sleeve 107. The grout body locator plate 104 is then attached to a vertical lateral brace 310 connected to straps 312 around the torque motor 110 or attached to the equipment arm to secure the grout body 102 in a fixed position. The grout port 118 in the grout body 102 and the holes in the grout shank 106 shall be on same the level (aligned) for grout injection into the 1.875 inch hollow space 122 in the interior of the grout shank 106.

The 3 inch diameter by 9⅞ inches stop type coupler 126 with smooth bore side up is slid over the bottom end of the grout shank 106 approximately 2 inches with shear pin bolt holes aligned with holes in the coupler 126 to allow shear pin bolt 117 to be inserted through the coupler and grout shank nutted with washers on both ends wrench tightened to secure in place connecting all rotating items of the spin drilling and grouting assembly 100.

The grout hose 306 is connected to the grout body port 118, i.e., grout injector. The assembled spin drilling and grouting assembly 100 with the threaded half of the 3 inch by 9⅞ inch stop type coupler 126 at the bottom can now be spun on to the 3 inch threaded portion of the pipe section 202, and the shear pin 117 inserted being nutted with washers wrench tight at both ends. The pipe section 202 can then be spin drilled and grouted to its designated depth. After spin drilling and grouting the pipe section 202 to depth, the drilling and grouting assembly 100 can be removed from the installed pipe section by removing shear pin 117 and reverse spinning the assembly 100 from the pipe section.

The pipe coupler 204 for the next pipe section 202 can be manually spun onto the 3 inch threaded top of the already installed pipe section 202. Once the next pipe section has been spun into place and secured with shear pin, it too can be spin drilled and grouted to depth. Installation of each additional pipe section can be repeated as described above for the first and second pipe sections and as described previously in connection with FIGS. 5-8.

Removing the installed helical anchor 201 (regardless of the number of pipe sections 202) requires rotating the spin drilling and grouting assembly 100 in the reverse direction. To avoid spinning the pipe couplers 204 off the pipe sections 202, holes are required in opposite ends of both the pipe couplers and the pipe sections for alignment and insertion of the ⅞ inch shear pin bolts through the holes and nutted with washer wrench tightness. Both ends of each pipe coupler require shear pins to secure the coupler and each pipe section into position.

The unique spin drilling and grouting assembly 100 of the present invention comprises a grout body 102, a grout shank 106, a grout shank pipe coupler 126, and a torque drive connection coupler 114. The grout body 102 has an internal cylindrical space 103 (see FIG. 10), a grout port 118 projecting outwardly from the grout body in fluid communication with the internal space 103, and a locater plate 104 projecting outwardly from the body 102. The internal cylindrical space 103 has a preferred internal diameter of three inches, but can vary between about 2 inches and about 4 inches. The grout port 118 has an essentially cylindrical hole extending through the wall of the grout body and a preferred diameter of one inch. However, the size of the grout port 118 can vary depending upon the overall size of the spin drilling and grouting assembly 100.

The locater plate 104 serves to secure the grout body 102 rotationally in place, i.e., with respect to the external casing of torque motor 110 that drives torque shaft 108. There is preferably a hole in the drive plate that facilitates connection to the torque motor casing, and such types of connections are well known to those skilled in the art. The grout port 118 and locater plate 104 are preferably centered between the opposing ends of the grout body 102 but the position of the grout port and locater plate can vary. The length of the grout body 102 is preferably 8.062 inches and has a general cylindrical shape (exterior), excluding the grout port and locater plate, with a preferred outside diameter of 4.75 inches, but can vary between about 3 inches and about 6 inches. A 6 inch outside diameter grout body would accommodate a 4 inch outside diameter grout shaft. The length of the grout body can vary from about 8 inches to about 12 inches. The grout body 102 can be made preferably of steel, but could be stainless steel, ceramics, carbon fiber, or other suitable material.

The hollow grout shank 106 is essentially tube-shaped, having smooth internal and external surfaces, with a preferred length of 12.062 inches, internal diameter of 1.875 inches, and external diameter of 3 inches. The grout shank can vary from about 12 inches to about 18 inches in length and from about 2 inches to 4 inches in outside diameter. There can be any number of grout holes 120 circumferentially spaced around the grout shank, each of which aligns with the grout port 118 once every complete rotation of the grout shank inside the grout body, limited of course by the diameter size of the grout shank. Preferably, the grout shank has 1-4 grout holes, more preferably 2-4 grout holes and most preferably 4 grout holes. The size of the grout hole is generally circular and sized to meet the diameter of the grout port in the grout body. The at least the one grout hole 120 is preferably located midway between the longitudinal ends of the grout shank; however, the location of the grout port in a grout body and the at least one grout hole in the grout shank must be coordinated, such that when assembled—in the drilling and grouting assembly 100—the grout port and the at least one grout hole are in alignment with one another. The grout port and grout hole can be of different diameters or the same diameter. Generally, grout ports can be a lesser diameter to restrict flow. The grout port and grout hole are typically sized to prevent plugging and provide adequate flow. One-inch grout ports and grout holes are typical. Grout ports can range from ¾ inch to 1¼ inches, and the grout holes sized accordingly.

The grout shank 106 also includes a grout plug 124 inside the grout shank that completely fills the internal diameter of the grout shank. The grout plug is located between the at least one grout hole and the upper end of the grout shank that is to be rotationally secured to the torque drive of the torque motor; thereby, pressurized grout pumped into the grout shank through the at least one grout hole is blocked from moving upwardly (i.e., reaching the end of the grout shank secured to the torque drive) and is forced in the opposite direction (i.e., downwardly toward the end of the grout shank rotationally secured to the anchor pipe coupler 126). The grout shank also includes two through holes, circular in cross section, preferably centered 1" from opposing ends of the grout shank for accommodating shear pins 116 and 117.

The torque drive connection coupler 114 is a smooth bore coupler most preferably 6 inches long with a 4.5 inch outside diameter and a 4.056 inch inside diameter. The bottom of the torque drive connection coupler 114 is positioned above and spaced a short distance from the top of the grout body 102 in order that the coupler can rotate freely with respect to the grout body. The coupler 114 has two shear pin holes of essentially circular diameter, the bottom shear pin hole preferably centered about 1 inch from the bottom of the coupler, and a top shear pin hole preferably centered about 2 inches from the top of the coupler, the bottom shear pin holes aligns with the shear pin holes at the top of the grout shank 106, and a shear pin bolt 116, 0.875 inch diameter, passes through the aligned holes in the coupler and grout shank, is washered at both ends, and nutted wrench tight, thereby rotationally securing the coupler 114 to the grout shank 106.

In operation the output shaft 108 (torque drive) of torque motor 110, which shaft has a through hole, and which shaft typically has a hexagonal shape about 3.57 inches across, fits into the top of the torque drive connection coupler 114 and rests atop the grout shank 106, which is secured to the coupler, such that the hole in the torque drive aligns with the shear pin holes at the top of the coupler and a shear pin bolt 116, 0.875 inch diameter, is placed through the coupler holes and aligned drive hole, washered at both ends, and nutted wrench tight, thereby rotationally securing the coupler and the grout shank to the torque drive.

The grout shank 106 must extend above the top of the grout body 102, preferably about 2 inches, in order to be rotationally secured to the coupler 114 while being able to rotate freely within the grout body 102; which extension creates a space between the outside surface of the grout shank and the inside surface of the coupler. A pipe sleeve 107 is therefore preferably inserted in the space around the top of the grout shank, filling the space.

Figure 13:
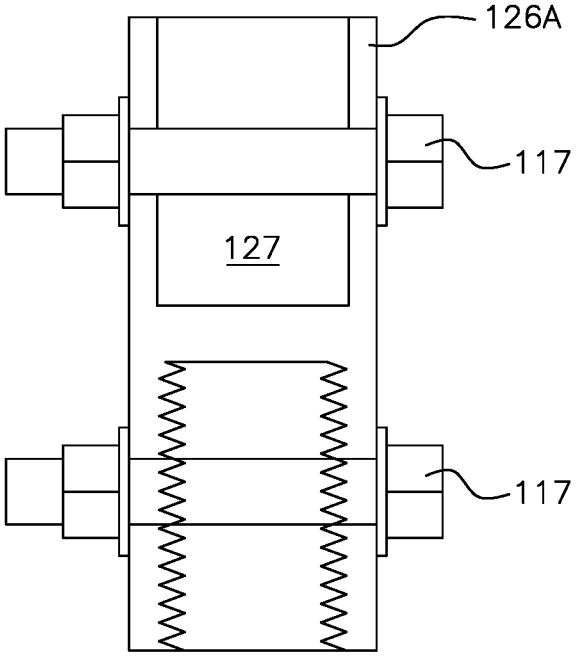
FIG. 13 is a cross sectional view of a more preferred anchor pipe coupler than that shown in FIG. 9, showing a smooth-wall connection with a shear pin at its top to the extended bottom of the grout shank and connection with a shear pin at its bottom to the externally threaded pipe (hollow bar) section of a helical anchor, in accordance with the present invention.

A more preferred anchor pipe coupler 126A for assembly to the bottom of the pipe sleeve 122 is shown in FIG. 13. Preferred anchor pipe coupler 126A is formed with a smooth-wall upper cylindrical opening 127 for receiving the bottom of the pipe sleeve 106 which is originally connected thereto by sheer pin 117. The lower portion of the anchor pipe coupler 126A for connection to the top of pipe section 202 is the same as coupler 126 shown in FIG. 9.

A typical application of the grout filled helical anchor 201 together with a tensioning element 212, the combination generally designated by reference numeral 200, in accordance with the present invention is illustrated in FIGS. 2 and 3 in conjunction with a concrete foundation cap, generally designated by reference numeral 400. As is known in the art, the foundation cap 400 preferably includes an outer upstanding corrugated metal pipe (CMP) 402 at its perimeter which may, for example, be 24 feet in diameter and 5 feet in height. The outer CMP 402 is placed on top of the ground or in an excavation 404 formed in the ground and resting upon the bottom of the excavation 404 and grout leveling course 406. The void 408 between the outer CMP 402 and the edge of the excavation 404 is typically backfilled with clean sand or sand cement slurry 410.

The concrete foundation cap 400 include a series of tower anchor bolts 412, 414 spaced circumferentially about the central point of the foundation cap 400. The tower anchor bolts 412, 414 are preferably positioned in radial pairs forming two anchor bolt circles. The inner circle of tower anchor bolts 412 has a slightly smaller diameter than the outer circle of tower anchor bolts 414. For example, the outer tower anchor bolts circle may have a diameter of 14 feet and the inner tower anchor bolt circle may have a diameter of 13 feet. The tower anchor bolts 412, 414 are sleeved, preferably with PVC tubes 416 or the like, which cover the anchor bolts 412, 414 except for threaded portions at the top and bottom of the bolts. The anchor bolt sleeves 416, whether made of PVC or other material(s), prevent bonding of the bolts 412, 414 to the concrete and grout of the foundation cap 400.

The lower ends of the tower anchor bolts 412, 414 are anchored near the bottom of the concrete foundation cap 400 with an embedment ring 418. The embedment ring 418 is preferably about the same size as and complimentary to the tower base flange 420. The embedment ring 418 contains bolt holes for each of the anchor bolts 412, 414, and the bolts are secured in the bolt holes by any suitable securement, such as hex nuts below the embedment ring and hex nuts atop the embedment ring.

As shown in FIG. 3, the upper ends of the tower anchor bolts 412, 414 project upwardly through the tower base flange 420. Tower anchoring hex nuts 422 are threaded onto the upper end of the tower anchor bolts to secure the tower (not shown) to the concrete foundation cap 400. Grout 424, which is poured in the grout trough before placement of the tower and tower base flange, extends under the tower-based flange 420 to complete installation of the tower.

FIG. 3 shows complete views of the grout filled helical anchor assemblies 200 including tensioning elements 212, in-ground helical anchors 201, comprising interconnected hollow pipe sections 202, pipe couplers 204 and drill bits 213, and the continuous grout columns 210.

The method of the present invention comprises the steps of (a) providing a grout-filled helical anchor 201, the helical anchor including at least one hollow pipe section 202, preferably having no holes through the pipe walls, with top and bottom opposing externally threaded ends, at least one helical pipe coupler 204 having top and bottom ends, the top end of the helical pipe coupler rotationally secured to the bottom end of the externally threaded pipe section, and the bottom end rotationally secured to a drill bit 213, the helical pipe coupler having an externally mounted helical disk 206 and at least one grout hole 208 through the coupler wall, (b) spin drilling the grout-filled helical anchor into the ground, and (c) simultaneous with the spin drilling, continuously forcing pressurized grout into the top of the pipe section to fill the helical anchor and continuously force grout out of the helical anchor through the grout hole or holes in the helical pipe couplers into the surrounding soil as the anchor descends below the ground surface, such that when the top of the pipe section reaches the ground surface, a continuous column of grout 210 surrounds the helical anchor from the ground surface to the drilled depth of the helical anchor. The helical anchor is spin drilled into the ground at a preferred speed of 20 rpm, but can range between a lower drilling speed of about 10 rpm to a higher drilling speed of about 40 rpm. Grout is continuously forced into the top of the grout-filled helical anchor at a preferred pressure of about 400 psi, but can range from about 200 psi to about 900 psi.

The hollow pipe sections 202 of the helical anchor of the present invention are preferably about 10 feet long, with a 3 inch (76 mm) outer diameter, and a 1.89 inch (48 mm) inner diameter and with minimum net area through threads of 3.88 square inches (2503 $mm^2$). Such pipes are commercially available such as, e.g., B7Y1 Domestic Hollow Injection Bar available from Williams Form Engineering Corp. (Belmont, Michigan). Other sizes of pipe and bar sections can be used in accordance with the present invention as determined by those skilled in the art and depending upon the application for the helical anchor to be utilized. Standard pipe sections vary in length from ten feet to twenty feet, and cold rolled threaded hollow bar sections have pipe diameters between 1½ inches to 4 inches.

The helical pipe couplers 204 are a stop-type, internally threaded (from both ends) coupler having a preferred length of 9.875 inches (251 mm), and an internal (threaded) diameter of 3 inches (76 mm). Such a coupler is commercially available also from Williams Form Engineering Corp. (Belmont, Michigan). Couplers useful in accordance with the present invention can have lengths between 8 inches and 12 inches, with outside diameters between 2 inches and 6 inches and internal diameters of 1½ inches to 4 inches. The helical pipe coupler has an externally mounted (e.g., by welding thereto) helical disk, useful embodiments of which have diameters of 10 inches, 12 inches, and 14 inches. The size of the helical disc can range in diameter from 6 inches to 18 inches and if multiple discs are mounted on the same coupler, they should be separated by at least 3 inches.

While the interconnection of the hollow pipe sections 202 and helical pipe couplers 204 shown in the drawings and described herein is one where the ends of the hollowed pipe sections 202 have external threads and the ends of the helical pipe couplers 204 have internal threads, those skilled in the art will readily recognize that the reverse is equally effective: the ends of the hollow pipe sections 202 can be internally threaded and the ends of the helical pipe couplers 204 can be externally threaded. Either arrangement is fully contemplated in accordance with the present invention along with the requisite aligned shear pin holes and shear pin bolts and retaining nuts to rigidify the interconnection.

The spin drilling and grouting assembly 100 components are as follows:

- 4½ inch spin weight type sleeve with shear pin hole (1 inch) for connection to the output shaft drill drive and grout shank coupler;
- 3 inch dia.×2 inch long smooth coupler for grout shank with shear pin (⅞ inch bolt and washers);
- 12.06 inches long by 3 inch dia. grout shank with grout plug filling the 1.875 inch central void at top half of hollow shank, shear pin (i.e., ⅞ inch bolt and washers), and 1 inch holes, which are 2 inch below top and 2 inch above bottom;
- grout body 4.75 inch O.D., 3 inch I.D., with grout port and locator plate to secure grout body in position, preventing rotation of the grout body; and.
- 3 inch dia.×9.875 inch long stop-type coupler threaded 4.4 inch into only the bottom half with 1 inch holes in the upper smooth half of the coupler and the bottom threaded half of the coupler for shear pins (⅞ inch bolts and washers) nutted with washers wrench tight.

The following are enumerated features of the present invention:

1. A soil anchor system with helical anchors to spin drill into soil with predetermined depth consisting of sections of hollow pipe coupled together with helical pipe couplers having grout holes for soil injection of grout continuously with spin drilling to depth by a spin drilling and grouting assembly connected to the output drive shaft of a hydraulic or electric torque motor to spin the helical anchor and to direct pressurized grout downward through the helical anchor for injection into the surrounding soils through the coupler grout holes. The pipe sections and helical pipe couplers are rotationally secured to each other with shear pin bolts to allow the helical anchor to be removed by reverse spinning of the helical anchor. The helical anchor can have an ungrouted tensioning element connected at the top of the anchor for post-tensioning the installed anchor.
2. The post-tensioning of the tensioning element and helical anchor requires a sleeve over the tensioning element to prevent bonding with the concrete foundation or structure being secured in place by anchor post-tensioning.
3. A spin drilling and grouting assembly connects to the torque motor drive to spin drill the helical anchor into the soil while injecting grout simultaneously into the anchor for anchor and soil grouting. The spin drilling and grouting assembly also provides for spin drilling the helical anchor out of the soil by reversing the direction of the torque motor drive.
4. Shear pin bolts are nutted with washers to rotationally secure the drilling and grouting components together in position.
5. Shear pin bolts are nutted with washers to secure the helical pipe couplers to the pipe sections to prevent thread turning during spin drilling into and removal from soil.
6. Spin drill and simultaneously grout to depth and continue grouting during anchor removal to cast a column of grout. Grout column diameters can be larger than helical diameter by pressurized grout compression of surrounding soils.
7. Spin drill and grouting helical anchor into position at preferred angles for abutment and other structure restraint.
8. Spin drilling and grouting helical anchor for tieback support of precast retaining wall placed and secured before backfilling behind the retaining wall and post-tensioning the anchor.
9. Angled or vertical pressure grouting to stabilize or lift foundations by spin drilling into position of need then pressure grouting as helical anchor is removed. Pressure grout may require grouting only from selected grout ports, thus requiring other grout ports be plugged with shear pins bolted and nutted.
10. Spin drill and grout during drilling and removing of helical anchor to cast a grout column around a rock anchor steel tendon in the soil above the rock for compression bearing support of the foundation or structure above when post-tensioned.
11. A cementitious grout column can be cast by drilling and grouting simultaneously into and out of the soil above the rock to support foundations or structures before drilling the rock anchor through the grout column into the rock.
12. The spin drilling and grouting assembly, torque motor and helical anchor components mounted and connected to a backhoe or excavator hydraulic arm provides versatility, flexibility and simplicity to perform anchoring for most jobs without specialized equipment.
13. The spin drilling and grouting assembly is made up of components generally available near the work place making assembly and replacement of components timely and expedient.
14. The spin drilling and grouting assembly as well as the helical anchor installation grouted in place requires moderately sized equipment standard and common to the industry.
15. Post-tensioned grouted helical anchor preconstruction performance testing for anchor capacity in the weakest project soil conditions determines least anchor capacity in worst conditions and determines if need for modification of anchor is required.

16. Every installed helical anchor is post-tensioned to lock off load (factored loads) verifying that every helical anchor meets or exceeds the required design load without modification.
17. Preconstruction testing and post-tensioning lock off (generally 133% of the design loading) for each helical anchor meets "Post-tensioning Institute Guidelines for Rock and Soil Anchors" and verifies design adequate to prevent failure as installed.
18. Post-tensioned grouted helical anchors which require preconstruction testing and post-tensioning to design factored loading for soil conditions determined by project geotechnical investigation acceptable as utilized in the anchor design.
19. The extensive geotechnical investigation for post-tensioned or large helical anchor projects can be simplified and specifically directed to soil identification. Final anchor design will be determined by preconstruction anchor testing at the project site.
20. The sampling and testing as well as assembled costs of geotechnical investigation and preliminary soils report preparation can be reduced by approximately 50% for post-tensioned grouted helical anchors versus other shallow and deep foundation design requirements.
21. Final geotechnical report testing is reduced in scope and effort as the construction earthwork and materials requiring sampling and testing are reduced for post-tension grouted helical anchors and foundations.
22. Post-tensioning of the helical anchor compresses foundation underlying supporting soils and simultaneously elongates the anchors.
23. Post-tensioning of the helical anchors to specified lock off loads (greater than the maximum design load) alleviates further foundation anchor elongation and foundation lift even if maximum design load occurs.
24. Post-tension compression loading of the foundation to above the design loading compresses the soils under the foundation and above the soils compressed by the high pressure helical anchor grouting. Additional compressive loading from foundation supporting structures and/or equipment will increase the compression on the foundation and foundation supporting soils. Additionally consolidating the foundation supporting soils will reduce the post-tension loading and anchor elongation offsetting the added load and reducing any additional soil consolidation as long as consolidation is within the elastic range of the foundation underlying soils.
25. Foundation design criteria can be met by the addition of post-tensioned grouted helical anchors including allowable settlement, lateral displacement, rotation, frequency, and fatigue.
26. The allowable settlement of foundation is determined by bearing capacities and stiffness of underlying soils. Post-tensioned grouted helical anchors increase soil bearing capacity and stiffness through consolidation and density increases in the soil by high pressure grouting around the anchor and by anchor post-tension.
27. Lateral displacement occurs when sliding loads exceed sliding resistance. The posttension of the grouted helical anchor and foundation plus structure weights increase the skin friction between the bottom of the foundation and the underlying soils to a minimum sliding factor of 2.0.
28. Structure rotation due to overturning moments are resisted by anchor couples around the foundation and structures centroid consisting of weight or tension downward and upward bearing resistance of soils plus deep embedded grouted vertical pile type anchors driven or drilled to prevent downward and upward deflection of the foundation such as the post-tensioned grouted helical anchor supporting the foundation by concrete extension of pressure-grouted columns to contact the bottom of the foundation or a plate over the hollow bar with a hollow bar nut turned tight to secure the plate against the bottom of the foundation.
29. Frequency movement of the supporting structure or equipment cyclic loading, can be reduced and the rotational stiffness increased by stiffening the foundation support using post-tensioned grouted helical anchors.
30. Fatigue life of the foundation and supported structure materials can be increased by reducing cyclic movement and stress reversals with foundation stiffening by post-tensioned grouted helical anchors.
31. Post tensioned grouted helical anchors reduce the volume of concrete. A helical anchor with a pull out capacity of 400,000 lbs is equal to approximately 100 cubic yards of concrete.
32. Post-tensioned helical anchors can be added as retrofits to existing concrete foundations to increase loading capacity, reduce foundation movement by increasing foundation support; and stiffness fatigue life of foundation and support is increased.

Additional Description of Preferred Embodiments

Spin drilling and grouting assembly 100—the assembly connects to a drive motor normally connected to a backhoe or excavator arm. The assembly can spin helical anchor clockwise or counterclockwise to install helical anchors into the ground or remove from the ground with or without simultaneous grouting at pressures up to 900 psi. The assembly is sized preferably for 3 inch hollow bar anchor sections 202, but can be fabricated for anchor sizes −25% or +75% of preferable with ultimate strengths up to 1,000,000 lbs having torque capacities of approximately 100,000 ft-lbs.

Hollow bar helical anchors 201 are assembled using hollow bar sections 202 connected together by couplers 204 which are partially threaded (top and bottom) for turning onto threaded hollow bar and secured by shear pins through the coupler and hollow bars (top and bottom). The secured hollow bar anchor can be spin drilled into the ground and partially removed all while simultaneously grouting using clockwise and counterclockwise rotation of the helical anchor. The hollow bar sections 202 can be all threaded around the perimeter to bond to the injected high pressure grout column 210 encasing the anchor. The grout column also increases the contact area of the soil and compresses the surrounding soil increasing the skin friction resistance to anchor movement up or down.

The preferred anchor overall length is 40 ft (4-10 ft. Sections of hollow bar 202) with 3 helical anchors 204 (10 inch, 12 inch, and 14 inch). Each of the preferred dimensions above can be reduced by 25% and increased by 75%.

The grouted helical anchors can be utilized in several applications. Some of the applications require foundation additions to allow the anchors to act in tension and/or compression for structure support. These anchor applications include the addition of tensioning elements 212 with PVC pipe sleeves 214, steel plates with nuts and washers, styrofoam blockouts, and uniform bearing sections.

All of the following anchor applications can be installed by the spin drilling and grouting assembly 100.

Pressure grouting application can stabilize structures during and after construction for remediation purposes. Compression grouting application requires injections of high pressure grout to cast bulbs of grout concentrations displacing and consolidating surrounding soil materials increasing the soil bearing strengths to stabilize soils or lift the above supported structure.

For pressure grouting to raise and level supported structures, the anchor is angled for grout injection under structure foundation. One anchor assembly for injection of grout may be utilized for all the pressure grouting injections. It is not necessary to leave the anchor in place.

The tie-back application to support horizontal retaining wall structures and the like can be installed during construction and remediation. The anchor tie-back application requires injection of high strength grout to consolidate soils surrounding the all threaded hollow bar anchor and form grout column casting bonding to the bar and increasing skin friction/cohesion strength of the soil to provide post tension lateral loading to the anchor.

The tie-back anchor 201 may have several helical anchor couplers along with a drill bit 213. The anchor is intended to be a tension anchor. The tie-back anchor and a tensioning element assembly 200 has a PVC sleeve around the tensioning element to allow post tension of the anchor. A bearing plate with securing nut and washer is installed on the outside of the retaining wall for post tensioning. The tie-back anchor may be simultaneously grouted during installation, partial removal, and re-spin drilling. Several tie-back anchors are likely required to secure a retaining wall into position or remediation of an existing retaining wall.

The tie-back anchor design should be trial tested before construction or remediation to verify that the anchor pullout exceeds the ultimate strength of the anchor. The tie-back anchor or facsimile is a tension anchor.

Building structure application to support square, circular, and continuous foundations are primarily for compression bearing loads. The spin drill and grouted anchors 201 are to be spin drilled to depth and partially removed while simultaneously grouting then re-spin drilled to depth at least once to meet design grout quantities and pressure. The prestressed grout forms a column of high pressure grout 210 compressing the soils surrounding the threaded hollow bar sections 202 and helicals 206 welded to couplers 204 connecting the hollow bar anchor sections.

The building structure anchors 201 may have several hollow bar sections 202 connected by coupler 204 with helicals 206 and a drill bit 213 at anchor depth.

Building structure anchors 201 are primarily for compression bearing load support of the structure foundation. However, the anchors are post-tensioned and also have tension resistance.

The building structure anchor assemblies 200 have the tensioning elements 212 sleeved to prevent bonding to the concrete foundation for post tensioning. Steel bearing plates are placed atop and under the concrete foundation and are nutted with washer atop the upper plate and under the bottom plate. The bolt extension above the upper plate is lifted upward with a jacking system to post tension the bolt and secured by the nut and washer atop the upper plate. A corrugated metal pipe around the hollow bar at the bottom of the foundation when filled with concrete provides a uniform stress transfer of the foundation bearing stresses to the anchors.

The building structure anchors shall be trial tested before construction to verify the anchor bearing capacity meets or exceeds design.

Wind turbine cap with anchor foundation applications are primarily for both uplift tension and bearing compression loads due to structure overturning moments. Multiple helical anchors 201 are required in a circular configuration. The helical anchors are spin drilled and simultaneously grouted to depth. The anchor must be able to be spin drilled into and out of the ground while simultaneously grouting a cylinder casting 210 around the threaded hollow bar and helices to meet grout design pressure and volumes.

The high pressure grout column 210 compresses the soils surrounding the all threaded hollow bar and helicals welded to the couplers connecting the hollow bar sections.

The anchors for the cap with anchor foundation require several hollow bar sections connected by couplers with helicals and a drill bit at depth to provide tension capacities greater than the ultimate strength of the hollow bar.

Anchors are required to be post-tensioned to control rotational stiffness of the foundation. Post-tensioning the anchors requires a sleeve through the concrete preventing bonding with the concrete. Tensioning the anchors requires a plate with nut and washer atop the foundation and a second plate with nut and washer under the foundation topped by styrofoam to allow the anchors skin friction to fully develop.

A corrugated metal pipe around the hollow bar is filled with concrete contiguous with the bottom of the foundation is provided for uniform load transfer to the foundation.

The anchors for the cap with anchors foundation shall be trial tested before construction to verify the anchor bearing capacity meets or exceeds the design.

For the purposes of this specification, including the appended claims, the terms "about" and "approximately" when modifying numbers expressing a number of sizes, dimensions, portions, shapes, formulations, parameters, percentages, quantities, characteristics and other numerical values used in the specification and claims, are meant to encompass the stated value plus or minus 10%.

The foregoing is considered as illustrative of the principles of the invention. Further, modifications and changes will readily occur to those skilled in the art. As such, it is not desired to limit the invention to the exact construction and operation shown and described; all suitable modifications and equivalents may be resorted to falling within the scope of the invention.

What is claimed is:

1. A spin drilling and grouting assembly for spin drilling a helical anchor into the ground, said assembly comprising:

a grout body held rigidly in place and having an internal cylindrical space and a grout port in fluid communication with said internal cylindrical space;

a hollow cylindrical grout shank sealingly positioned in the internal cylindrical space of said grout body to freely rotate therein and having a top configured to rigidly engage with a torque motor drive, a bottom configured to rigidly engage with a top of said helical anchor and at least one grout hole, said at least one grout hole aligning with the grout port once every complete 360 degree rotation of the grout shank; and said grout port configured to transfer grout from a pressurized source through said grout hole and into said hollow cylindrical grout shank upon alignment of the at least one grout hole with the grout port, said grout shank including a grout plug that completely fills an internal diameter of the grout shank and is located between the at least one grout hole and the grout shank top.

2. The spin drilling and grouting assembly according to claim 1, further comprising:

a torque drive connection coupler rotationally secured to said top of said hollow cylindrical grout shank; and an anchor pipe coupler rotationally secured to the bottom of said hollow cylindrical grout shank.

3. The spin drilling and grouting assembly in accordance with claim 2, wherein both said torque drive connection coupler is rotationally secured to said top of said hollow cylindrical grout shank and said anchor pipe coupler is rotationally secured to the bottom of said hollow cylindrical grout shank by nutted shear pin bolts.

4. The spin drilling and grouting assembly in accordance with claim 1, wherein the grout port is generally perpendicular to the internal cylindrical space of the grout body.

5. The spin drilling and grouting assembly in accordance with claim 1, wherein said hollow cylindrical grout shank includes a plurality of the grout holes equally spaced around a circumference of said grout shank.

6. The spin drilling and grouting assembly in accordance with claim 1, further comprising a locator plate projecting outwardly from the grout body to secure the grout body rotationally in place.

7. The spin drilling and grouting assembly in accordance with claim 6, wherein the locator plate is rigidly connected to a torque motor housing.

8. The spin drilling and grouting assembly in accordance with claim 1, wherein the internal cylindrical space of the grout body has a diameter of between about two inches and about four inches.

9. The spin drilling and grouting assembly in accordance with claim 1, wherein the hollow cylindrical grout shank has smooth internal and external surfaces, a length of about twelve inches to about eighteen inches and an outside diameter of about two inches to four inches.

10. The spin drilling and grouting assembly according to claim 1, wherein said hollow cylindrical grout shank includes four of the grout holes equally spaced around a circumference of said grout shank.

11. The spin drilling and grouting assembly according to claim 1, wherein the hollow cylindrical grout shank is configured to rotate at a speed of between about 10 revolutions per minute and about 40 revolutions per minute.

12. The spin drilling and grouting assembly according to claim 1, wherein the helical anchor is configured to remain in place in the ground with the transferred grout.

13. An apparatus for spin drilling and grouting a helical anchor into the ground, said apparatus comprising:

the spin drilling and grouting assembly in accordance with claim 2;

a torque motor having a torque drive rotationally secured to a top of the hollow torque drive connection coupler of the spin drilling and grouting assembly;

at least one pipe section rotationally secured at its top to a bottom of the anchor pipe coupler of the spin drilling and grouting assembly;

at least one helical pipe coupler having an externally mounted helical disc and at least one grout hole in a wall of the coupler connected at its top to a bottom of the pipe section; and a drill bit rotationally secured to a bottom of said at least one helical pipe coupler.

14. The apparatus for spin drilling and grouting a helical anchor into the ground in accordance with claim 13, wherein there is a plurality of the pipe sections and a plurality of the helical pipe couplers fixedly connected alternately in series.

15. The apparatus for spin drilling and grouting a helical anchor into the ground in accordance with claim 14, wherein there are four of the pipe sections and four of the helical pipe couplers.

* * * * *